US005911098A

United States Patent [19]

Gyotoku et al.

[11] Patent Number: 5,911,098

[45] Date of Patent: Jun. 8, 1999

[54] DEVELOPMENT APPARATUS AND METHOD USING SELECTIVELY APPLIED AC VOLTAGES

[75] Inventors: Eiji Gyotoku, Itami; Tamotsu Shimizu, Settsu, both of Japan

[73] Assignee: Minolta Co., Ltd., Osaka, Japan

[21] Appl. No.: 09/014,396

[22] Filed: Jan. 27, 1998

[30] Foreign Application Priority Data

| | | | |
|---|---|---|---|
| Jan. 28, 1997 | [JP] | Japan | 9-013754 |
| Jan. 28, 1997 | [JP] | Japan | 9-013755 |
| Feb. 20, 1997 | [JP] | Japan | 9-035430 |

[51] Int. Cl.[6] ..... G03G 15/08; G03G 15/09

[52] U.S. Cl. ..... 399/264; 399/269; 399/270; 399/271; 399/266; 430/122

[58] Field of Search ..... 399/264, 266, 399/270, 269, 271, 285, 231; 430/120, 122

[56] References Cited

U.S. PATENT DOCUMENTS

| | | | |
|---|---|---|---|
| 4,493,882 | 1/1985 | Kaneko et al. | 430/97 |
| 4,610,531 | 9/1986 | Hayashi et al. . | |

FOREIGN PATENT DOCUMENTS

| | | |
|---|---|---|
| 59-223467 | 12/1984 | Japan . |
| 60-125863 | 7/1985 | Japan . |
| 5-142918 | 6/1993 | Japan . |
| 7-134462 | 5/1995 | Japan . |

*Primary Examiner*—Joan Pendegrass
*Attorney, Agent, or Firm*—Burns, Doane, Swecker & Mathis, LLP

[57] ABSTRACT

A development apparatus according to the invention comprises at least two developer carrier members in juxtaposition for transporting a developer material to a development region between the developer carrier members and an image bearing member in opposed relation. An AC voltage applying device is adapted to apply AC voltages to the respective developer carrier members thereby applying AC electric fields to the respective gaps between the developer carrier members and the image bearing member based on an active period to apply the AC electric field and an inactive period to apply no AC electric field. When one of the adjacent developer carrier members is subject to the active period, the other developer carrier member is subject to the inactive period.

16 Claims, 21 Drawing Sheets

PRIOR ART

DEVELOPMENT APPARATUS AND METHOD USING SELECTIVELY APPLIED AC VOLTAGES

BACKGROUND OF THE INVENTION

This application is based on applications No. 13754/1997, 13755/1997 and 35430/1997 filed in Japan, the contents of which is hereby incorporated by reference.

1. Field of the Invention

The present invention relates generally to a development apparatus and a development method utilized for developing an electrostatic latent image formed on an image bearing member in an image forming apparatus such as copying machines, printers and the like, and more particularly to a development apparatus and a development method adapted to produce an image featuring an adequate image density and good gradations including halftone and to prevent toner particles of a developer material from being scattered out of the apparatus or carrier particles of the developer material from being adhered to the image bearing member even when high-speed image forming operations are performed.

2. Description of the Related Art

Various types of development apparatuses have conventionally been employed by the image forming apparatuses such as copying machines, printers and the like, for developing the electrostatic latent image formed on the image bearing member. FIG. 1 shows one type of such development apparatuses.

As seen in the figure, the development apparatus comprises a cylindrical developer carrier member 11 opposing an image bearing member 1 and having a magnet roller 16 mounted to its inner periphery. The development apparatus body 10 contains a developer material 2 therein and includes a developer supply member 12 such as of a bucket roller for supplying the developer material 2 to the developer carrier member 11.

The developer supply member 12 within the apparatus body 10 is rotated for supplying the developer material 2 to a surface of the rotated developer carrier member 11. The developer material 2 is magnetically held to the surface of the developer carrier member 11 by means of the magnet roller 16, thus transported as the developer carrier member 11 rotates. After a regulating member 13 has regulated the amount of developer material 2 to be transported to a development region between the developer carrier member 11 and the image bearing member 1 in opposed relation, the developer material 2 is supplied to the development region for developing the electrostatic latent image formed on the image bearing member 1.

The development apparatus of the above construction is designed to achieve efficient development of the electrostatic latent image recorded on the image bearing member 1 and to prevent a magnetic brush of the developer material 2 from scraping off a toner powder image formed on the image bearing member 1. That is, as seen in FIG. 1, the developer carrier member 11 is applied with a DC voltage from a DC voltage source 14 and an AC voltage from an AC voltage source 15 in superimposition so that an electric field with an AC electric field superimposed on a DC electric field is applied to the development region between the developer carrier member 11 and the image bearing member 1 in opposed relation thereby performing the development process.

However, where the electric field with the AC electric field superimposed on the DC electric field is applied to the development region between the developer carrier member 11 and the image bearing member 1 in opposed relation thereby developing a halftone image, variations in the surface potential of the image bearing member 1 entail significant variations in image density and hence, a favorable halftone image cannot be obtained. The resultant halftone image does not feature good gradations nor necessarily have a good texture.

In this connection, U.S. Pat. No. 4,610,531 discloses a development apparatus arranged such that a first period (active period) to apply the AC electric field to a gap between the developer carrier member and the image bearing member and a second period (inactive period) to apply thereto no AC electric field are repeated in an alternating sequence while the electric field is invariably applied in a direction to attract the developer material back to the developer carrier member at the end of the first period.

In this instance, as disclosed in the above patent publication, wherein the AC electric field is applied in the first period at the end of which the electric field is invariably applied in the direction to attract the developer material back to the developer carrier member, the developer material moving between the image bearing member and the developer carrier member is invariably attracted from the image bearing member back to the developer carrier member when the AC electric field becomes inactive. In this state, the second period starts while the developer material continues to be attracted back to the developer carrier member.

This leads to a failure to supply a sufficient amount of developer material to the image bearing member in the subsequent period to apply the AC electric field for developing a latent image and hence, a resultant image suffers a reduced image density. Particularly, in the high-speed image forming operations currently practiced, the resultant image suffers an even lower image density as well as poor texture.

Where the development process is performed by applying the AC electric field besides the DC electric field to the development region between the developer carrier member 11 and the image bearing member 1 in opposed relation, as described above, a toner contained in the developer material 2 forms a toner powder cloud which increases the efficiency of the development process.

Unfortunately, such a toner forming the toner powder cloud is apt to be scattered out of the development apparatus body 10 and therefore, the image forming apparatus, such as copying machines, employing such a development apparatus suffers contamination of the interior thereof with the toner thus scattered or produces unwanted fogged images. Additionally, a carrier of the developer material 2 is apt to adhere to the image bearing member 1 because of the effect of the aforesaid AC electric field, so that a resultant image suffers carrier fogs.

In recent attempts to overcome such drawbacks, various constructions have been disclosed. For example, Japanese Unexamined Patent Publication No. 60(1985)-125863 discloses a development apparatus arranged such that an electrode member is disposed downstream of the developer carrier member in a direction of the movement of the image bearing member as opposed by the image bearing member, the electrode member applied with a similar combination of AC and DC voltages to that applied to the developer carrier member so that toner particles scattered out of the apparatus body may be reduced. Further, Japanese Unexamined Patent Publication No. 59(1984)-223467 discloses a development apparatus arranged such that an electrode member is disposed in the development region between the developer carrier member and the image bearing member in opposed relation as interposed therebetween and an AC voltage is applied to at least one of the electrode member and the developer carrier member thereby performing the development process under the AC electric field.

However, in the instance of Japanese Unexamined Patent Publication No. 60(1985)-125863 wherein the electrode member is applied with the same AC electric field as that applied to the developer carrier member, when the toner forming the toner powder cloud is moved into the gap between the electrode member and the image bearing member in the development region defined between the developer carrier member and the image bearing member in opposed relation, the AC electric field applied to the gap between the electrode member and the image bearing member causes the toner in the form of the toner powder cloud to be scattered out of the development apparatus body. Thus, a failure of adequately controlling toner scattering results.

In the instance of Japanese Unexamined Patent Publication No. 59(1984)-223467 wherein the AC voltages are applied to the developer carrier member and the electrode member, respectively, in a manner such that the AC voltages of the same frequency are applied to the developer carrier member and the electrode member in synchronism, a potential difference between the developer carrier member and the electrode member stays constant so that the gap between the developer carrier member and the electrode member is not subject to the AC electric field. This results in a failure of allowing for an adequate dispersion of the toner particles in the developer material. If, on the other hand, AC voltages of different frequencies are applied to the developer carrier member and the electrode member, a potential difference between the developer carrier member and the electrode member temporarily increases to an excessive level. This results in the occurrence of current leakage between the developer carrier member and the electrode member.

SUMMARY OF THE INVENTION

It is therefore, an object of the invention to provide a development apparatus and method in which the developer material is transported by the developer carrier member to the development region opposed by the image bearing member while the AC electric field is applied to the gap between the developer carrier member and the image bearing member for performing the development process, the apparatus and method adapted to offer a favorable halftone image or an image suffering no image density decrease, and particularly to offer an image featuring adequate image density and fine texture even when the high-speed image forming operations are carried out.

It is another object of the invention to provide a development apparatus and method in which the developer material is transported by the developer carrier member to the development region opposed by the image bearing member while the AC electric field is applied to the gap between the developer carrier member and the image bearing member for performing the develop process, the apparatus and method adapted to prevent the toner of the developer material from being scattered out of the apparatus thereby preventing the scattered toner particles from contaminating the interior of the image forming apparatus or producing fogs on the resultant image.

It is still another object of the invention to provide a development apparatus and method in which the developer material is transported by the developer carrier member to the development region opposed by the image bearing member while the AC electric field is applied to the gap between the developer carrier member and the image bearing member for performing the development process, the apparatus and method adapted to prevent the carrier of the developer material from adhering to the image bearing member and producing fogs or the like on the resultant image.

In accordance with a first mode of the invention, there is provided a development apparatus comprising at least two developer carrier members in juxtaposition for transporting a developer material to a development region opposed by an image bearing member. The development apparatus further comprises an AC voltage applying device for applying AC voltages to the developer carrier members, respectively, so as to apply an AC electric field to the respective gaps between the developer carrier members and the image bearing member in a manner such that one of the adjacent developer carrier members is subject to the active period to be applied with the AC electric field while the other developer carrier member is subject to the inactive period to be applied with no AC electric field.

In the development apparatus according to the first mode of the invention wherein the development process is performed by applying the AC electric field to the respective gaps between at least two developer carrier members and the image bearing member, the image bearing member may be supplied with a sufficient amount of developer material because the respective developer carrier members supply the developer material to the image bearing member. In addition, since the development process is performed based on the active period to apply the AC electric field to the respective gaps between the developer carrier members and the image bearing member and on the inactive period to apply no AC electric field to the respective gaps therebetween, as described above, variations in the image density incident to the variations of surface potential of the image bearing member can be reduced. Thus is provided an image excellent in gradations or a favorable halftone image.

Furthermore, since the AC electric field is applied in the aforesaid manner such that when either of the two adjacent developer carrier members is in the active period, the other developer carrier member is in the inactive period, a greater amount of developer material may be supplied to the image bearing member in comparison with an arrangement wherein the two adjacent developer carrier members are simultaneously subject to the active period to be applied with the AC electric field or subject to the inactive period to be applied with no AC electric field. Hence, even in the high-speed development process, the apparatus of the invention offers an image featuring adequate image density and fine texture and also prevents the occurrence of current leakage between the two adjacent developer carrier members.

Furthermore, the development apparatus according to the first mode of the invention is capable of offering images featuring even finer texture and good reproducibility of fine lines or suffering no carrier adhesion by suitably varying the AC electric field applied to the adjacent developer carrier members.

In accordance with a second mode of the invention, there is provided a development apparatus comprising a developer carrier member for transporting the developer material to the development region opposed by the image bearing member, and a recovery member adjoining the developer carrier member and opposing the image bearing member. The AC voltage applying device is adapted to apply AC voltages to the developer carrier member and the developer recovery member, respectively, so as to apply AC electric fields to the respective gaps between the developer carrier member and the image bearing member and between the developer carrier member and the recovery member in a manner such that either of the developer carrier member and the recovery member is in the active period to be applied with the AC electric field while the other is in the inactive period to be applied with no AC electric field.

In the development apparatus according to the second mode of the invention wherein the AC electric fields are applied to the respective gaps between the developer carrier member and the image bearing member and between the recovery member and the image bearing member, the toner scattered out of the apparatus can be reduced and the carrier adhered to the image bearing member can be properly recovered if the AC electric fields are applied to the respective gaps in a manner such that either of the developer carrier member and the recovery member is in the active period to be applied with the AC electric field while the other is in the inactive period to be applied with no AC electric field.

More specifically, in the period during which the AC electric field is applied to the gap between the developer carrier member and the image bearing member, the toner in the developer material forms the toner powder cloud allowing for an efficient development process. On the other hand, the developer recovery member is in the inactive period during which the AC electric field is not applied and therefore, even if the toner forming the toner powder cloud is moved into the gap between the recovery member and the image bearing member, the toner does not maintain the form of toner powder cloud in the gap between the recovery member and the image bearing member, thus prevented from being scattered out of the apparatus body.

Conversely, in the period during which the AC electric field is applied to the gap between the recovery member and the image bearing member, the effect of the AC electric field causes the carrier adherent to the image bearing member to detach therefrom, thus facilitating the recovery thereof by the recovery member. On the other hand, the gap between the developer carrier member and the image bearing member is in the inactive period during which the AC electric field is not applied and therefore, the toner does not form the toner powder cloud to be moved into the gap between the recovery member and the image bearing member, thus prevented from being scattered out of the apparatus body.

In order to assure that the development apparatus according the second mode of the invention further positively prevents the toner scattering, a preferred arrangement may be made such that air flow produced by the rotation of the recovery member is utilized for returning the toner to the developer carrier member or that a DC voltage is applied to the recovery member thereby subjecting a gap between the recovery member and the developer carrier member to a DC electric field in a direction to transport the toner to the developer carrier member.

Additionally, in order to assure an even more efficient recovery of the carrier adherent to the image bearing member, a preferred arrangement may be made such that the recovery member is provided with a magnet for magnetically attracting the carrier or that a DC voltage is applied to the recovery member thereby applying a DC electric field to the gap between the recovery member and the developer carrier member in a direction to transport the carrier to the recovery member.

In accordance with a third mode of the invention, there is provided a development apparatus comprising a developer carrier member for transporting the developer material to the development region opposed by the image bearing member, and an electrode member interposed between the developer carrier member and the image bearing member in the development region. The AC voltage applying device is adapted to apply AC voltages to the developer carrier member and the electrode member, respectively, so as to apply AC electric fields to the respective gaps between the developer carrier member and the electrode member and between the electrode member and the image bearing member in a manner such that either of the developer carrier member and the electrode member is in the active period to be applied with the AC electric field while the other is in the inactive period to be applied with no AC electric field.

In the development apparatus according to the third mode of the invention wherein the electrode member is disposed in the development region between the developer carrier member and the image bearing member in opposed relation as interposed therebetween, if the AC voltages are applied to the electrode member and the developer carrier member, respectively, so as to apply the AC electric fields to the respective gaps between the developer carrier member and the electrode member and between the electrode member and the image bearing member, the toner may be efficiently separated from the developer material transported by the developer carrier member to the development region while the toner thus separated may be efficiently supplied to the image bearing member. This is effective to prevent the toner from being scattered out of the development apparatus or to prevent the carrier of the developer material from adhering to the surface of the image bearing member.

In the development apparatus according to the third mode of the invention adapted to apply the AC voltages to the developer carrier member and the electrode member, respectively, if the AC voltages are applied in a manner such that either of the developer carrier member and the electrode member is in the active period to be applied with the AC voltage while the other is in the inactive period to be applied with no AC voltage, there occurs no excessive potential difference between the developer carrier member and the electrode member and hence, the occurrence of current leakage between the developer carrier member and the electrode member is avoided.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Now preferred embodiments of the invention will hereinbelow be described in further detail by way of example with reference to the accompanying drawings.

Mode I

Figure 1:
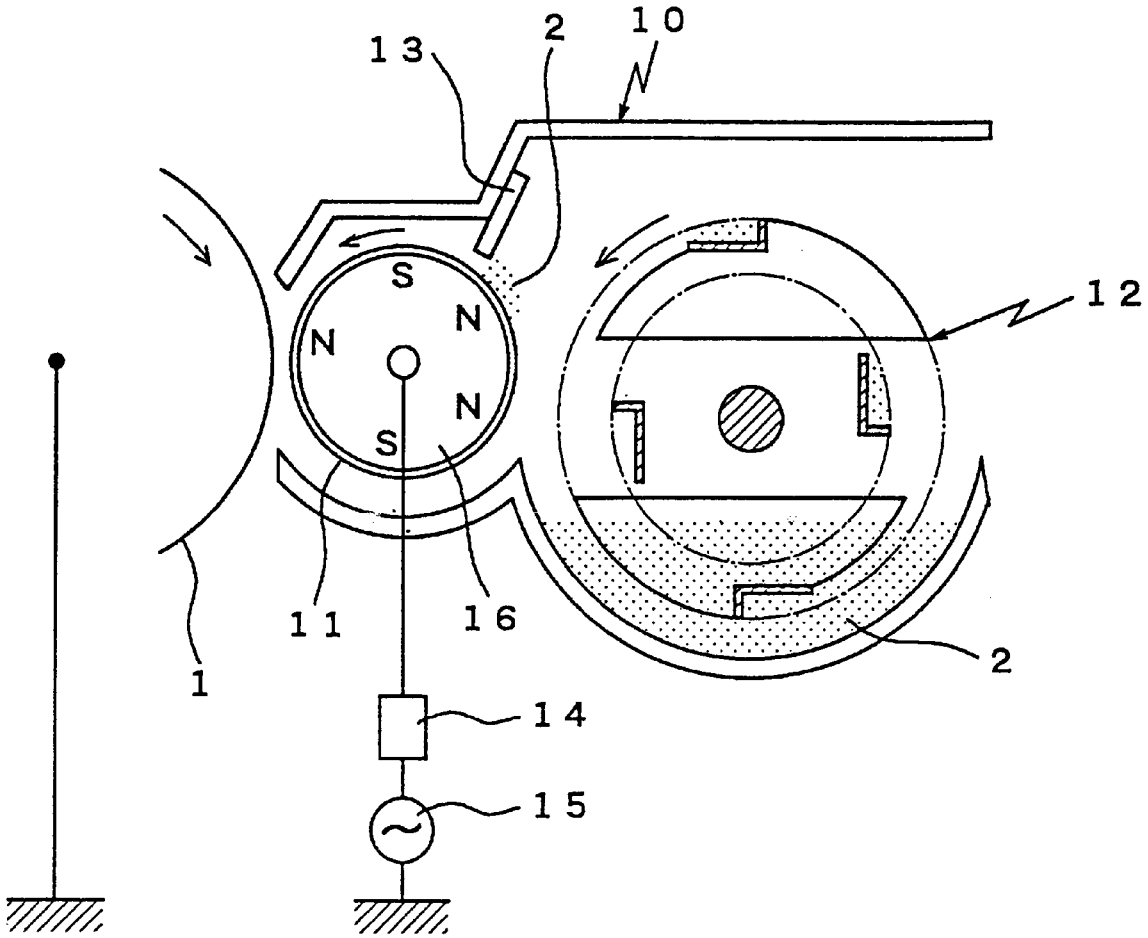
FIG. 1 is a schematic sectional view showing a state in which the development process is performed by a conventional development apparatus.
Figure 2:
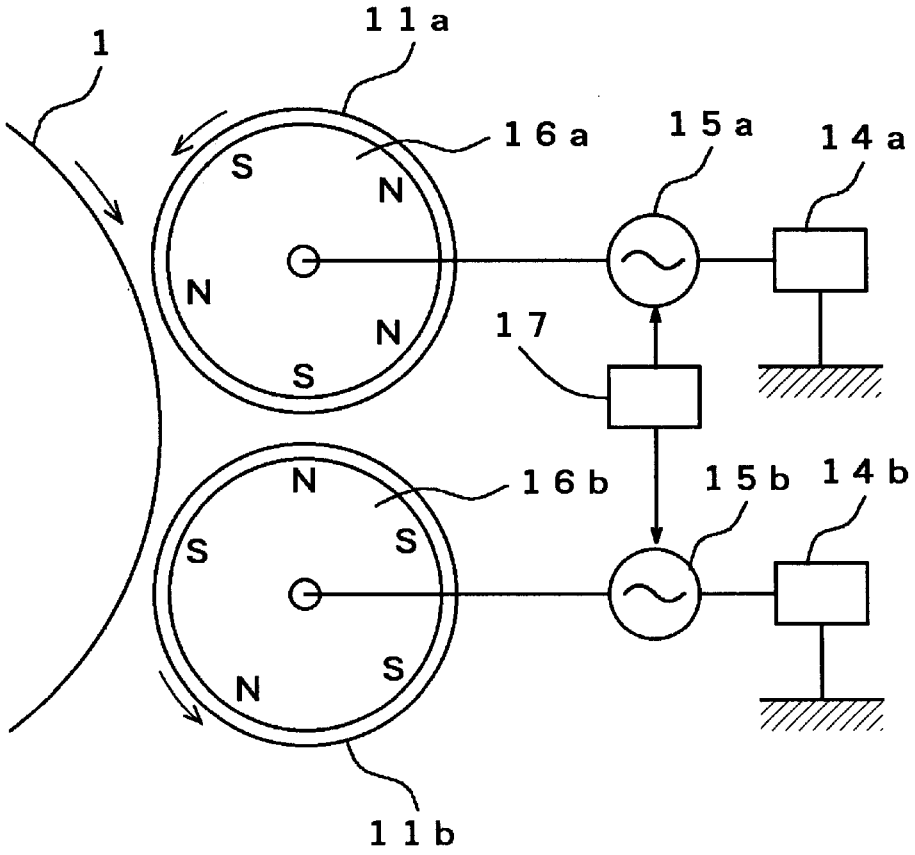
FIG. 2 is a partial schematic diagram showing a development apparatus according to Mode I of the invention wherein two developer carrier members are juxtaposed to each other as opposed by the image bearing member.

Referring to FIG. 2, a development apparatus according to Mode I of the invention comprises a first and second cylindrical developer carrier members 11*a* and 11*b* juxtaposed to each other and opposed by an image bearing member 1. The developer carrier members 11*a* and 11*b* have magnet rollers 16*a* and 16*b* mounted to their inner peripheries, respectively, the magnet rollers serving to magnetically hold a developer material to the respective surfaces of the developer carrier members 11*a* and 11*b*. In this state, the developer carrier members 11*a* and 11*b* rotate the developer material to a development region opposed by the image bearing member 1.

The developer carrier members 11*a* and 11*b* are connected to DC voltage sources 14*a* and 14*b* and AC voltage sources 15*a* and 15*b*, respectively. The developer carrier members 11*a* and 11*b* are applied with DC voltages from the DC voltage sources 14*a* and 14*b* and with AC voltages from the AC voltage sources 15*a* and 15*b*, respectively, while a control device 17 operates to control a timing to apply the AC voltage from the AC source 15*a* or 15*b* to the developer carrier member 11*a* or 11*b*.

Figure 3:
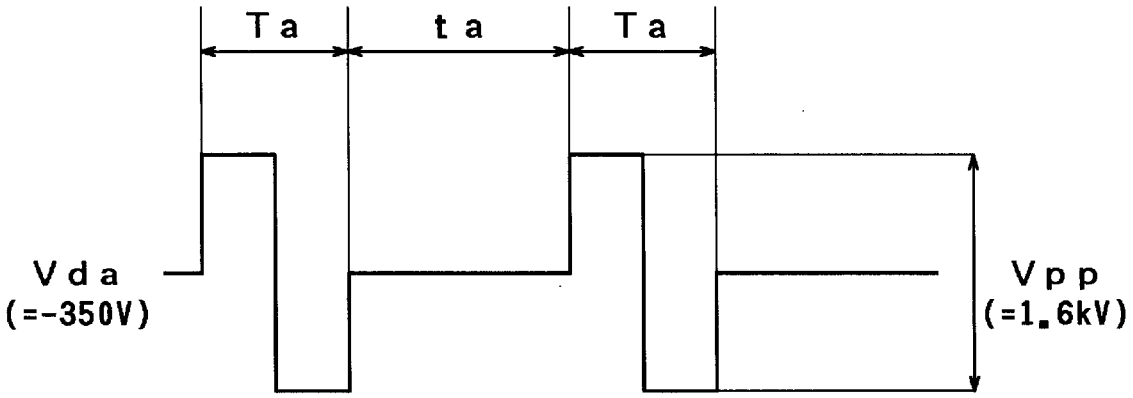
FIG. 3 includes diagrams each showing a state of voltage applied to each of the adjacent developer carrier members of the development apparatus according to Mode I of the invention.
Figure 3:
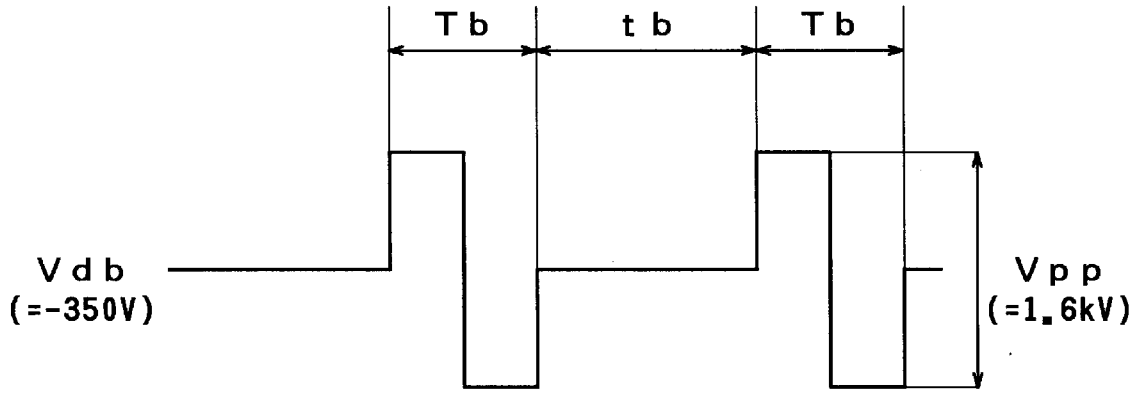

The development apparatus according to this mode is adapted to perform the development process by subjecting the respective gaps between the developer carrier member 11*a* and the image bearing member 1 and between the developer carrier member 11*b* and the image bearing member 1 to an electric field established by superimposing an AC electric field on a DC electric field based on an active period 'Ta' and 'Tb' to apply the AC electric field and an inactive period 'ta' and 'tb' to apply no AC electric field, the active period 'Ta' and 'Tb' and the inactive period 'ta' and 'tb' being repeated in an alternating sequence, respectively, as shown in FIGS. 3(A) and 3(B).

The development apparatus according to this mode is operated such that when the gap between the first developer carrier member 11*a* upstream of a movement of the image bearing member 1 and the image bearing member 1 is subject to the active period 'Ta' to be applied with the AC electric field, the gap between the second developer carrier member 11*b* on the downstream side and the image bearing member 1 is subject to the inactive period 'tb' to be applied with no AC electric field. Conversely, when the gap between the second developer carrier member 11*b* on the downstream side and the image bearing member 1 is subject to the active period 'Tb' to be applied with the AC electric field, the gap between the first developer carrier member 11*a* on the upstream side and the image bearing member 1 is subject to the inactive period 'ta' to be applied with no AC electric field.

Now, the arrangement of the development apparatus of Mode I of the invention wherein either of the developer carrier members 11*a* and 11*b* is subject to the active period while the other developer carrier member 11*b* or 11*a* is subject to the inactive period is compared with an arrangement wherein both the developer carrier members 11*a* and 11*b* are simultaneously subject to the active period or the inactive period.

Figure 4:
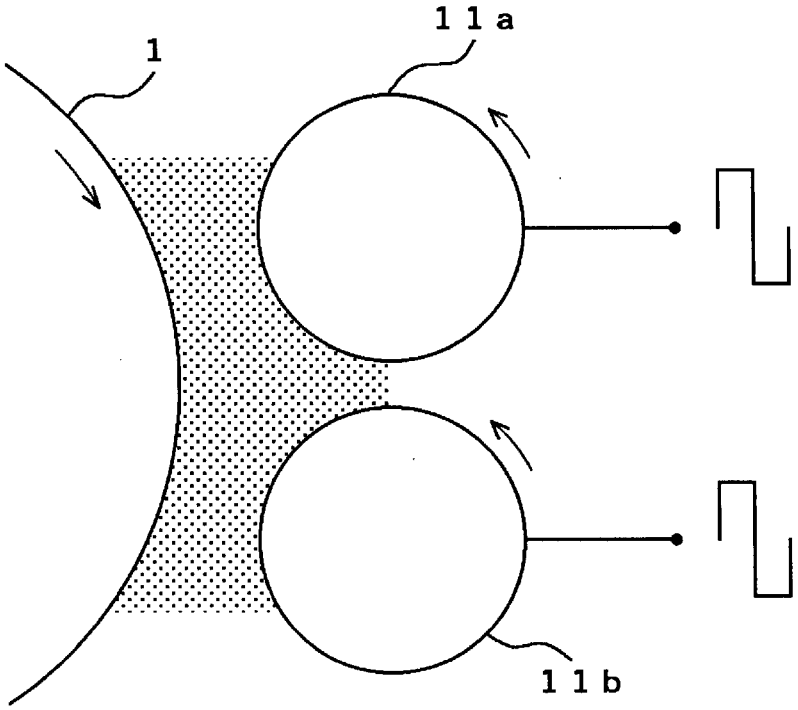
FIG. 4 includes schematic diagrams each showing a state of the developer material when the AC electric field is applied to a gap between the adjacent developer carrier members and the image bearing member in a manner such that the two developer carrier members are simultaneously in the active period to be subject to the AC electric field or in the inactive period to be subject to no AC electric field.
Figure 4:
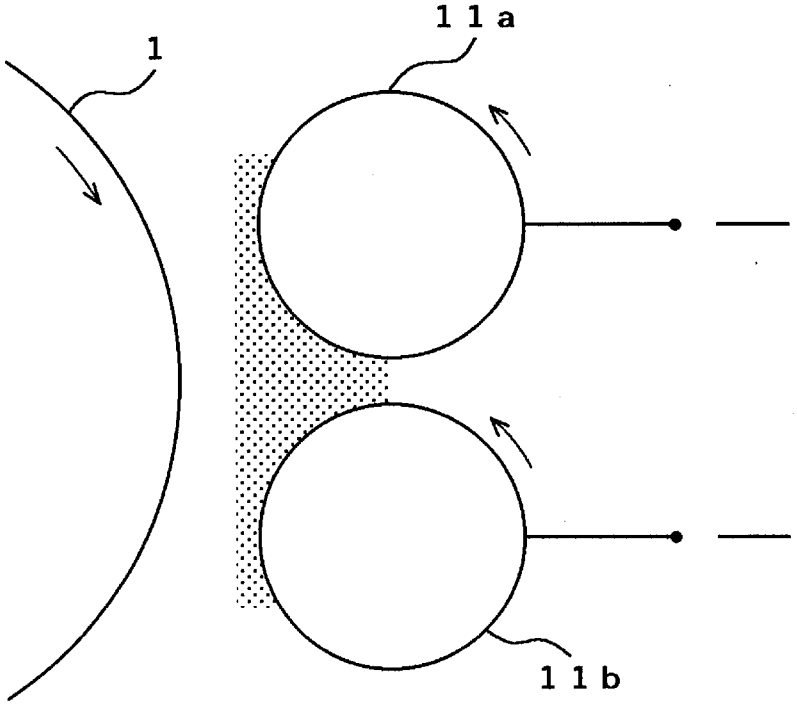

As seen in FIG. 4(A), when the two developer carrier members 11*a* and 11*b* are simultaneously subject to the active period to be applied with the AC electric field, a toner of the developer material 2 forms a toner powder cloud in gaps between the adjacent developer carrier members 11*a* and 11*b* and the image bearing member 1 so that the developer material 2 is supplied to a wide area of the image bearing member 1. However, when the developer carrier members are subject to the inactive period to be applied with no AC electric field, neither of the developer carrier members 11*a* nor 11*b* supplies the developer material 2 to the image bearing member 1, as shown in FIG. 4(B).

Figure 5:
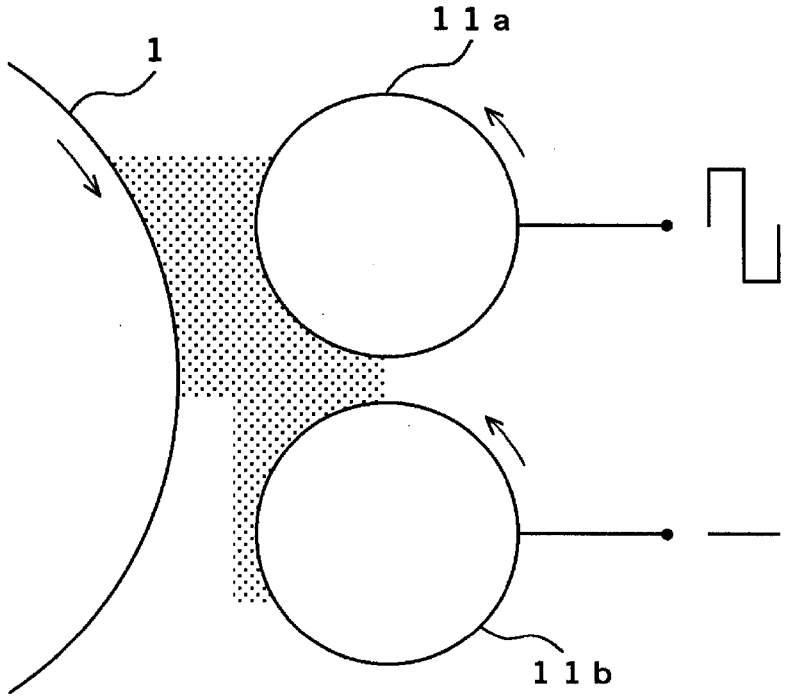
FIG. 5 includes schematic diagrams each showing a state of the developer material when the AC electric field is applied to the respective gaps between the adjacent developer carrier members and the image bearing member in a manner such that either of the developer carrier members is in the active period to be subject to the AC electric field while the other is in the inactive period to be subject to no AC electric field, as practiced by the development apparatus according to Mode I of the invention.
Figure 5:
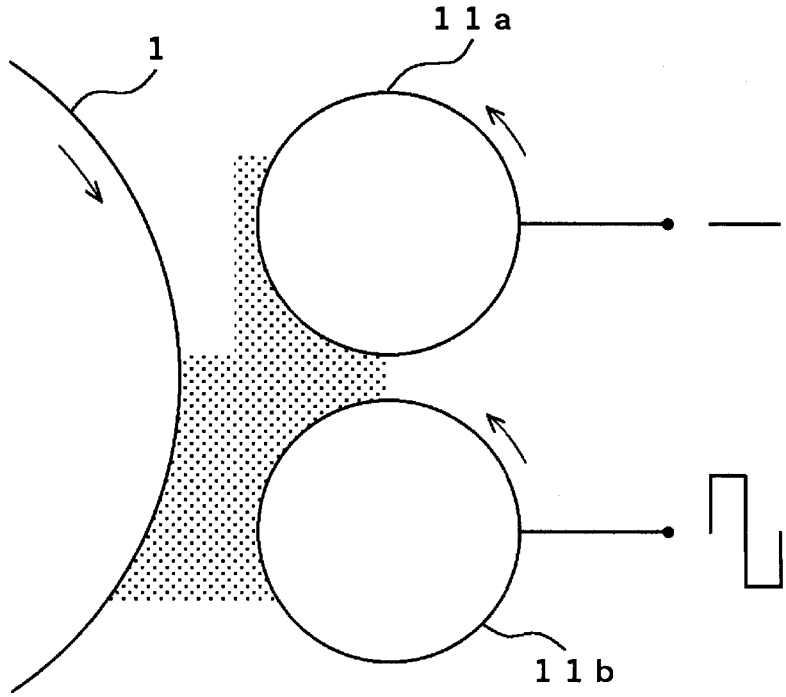

On the other hand, in the development apparatus of Mode I arranged such that either of the developer carrier members 11*a* and 11*b* is subject to the active period while the other is subject to the inactive period, when the application of the AC electric field to the developer carrier member 11*a* or 11*b* is switched between the active period to apply the AC electric field and the inactive period to apply no AC electric field, the developer material 2 always remains in the form of toner powder cloud covering either of the adjacent developer carrier members 11*a* and 11*b*, as shown in FIGS. 5(A) and 5(B). Accordingly, the toner powder cloud formed of the developer material 2 covers a wider area to be developed in comparison with the arrangement shown in FIGS. 4(*a*) and 4(B) wherein the adjacent developer carrier members 11*a* and 11*b* are simultaneously subject to the active period or the inactive period. Thus, the image bearing member is supplied with a sufficient amount of developer material 2 to produce an image with an adequate image density even in the high-speed development process.

As to the development apparatus according to Mode I of the invention, a comparison was made among a development apparatus of Example 1 and development apparatuses of Comparative Examples 1 to 3 which performed the development process under varied operating conditions such as electric fields applied to the gaps between the developer carrier members 11*a* and 11*b* and the image bearing member 1, and the like. The comparison clarifies that the development apparatus of Example 1 offers an image featuring a sufficient image density and excellent gradations including halftone even when the development process is performed at high speed.

Example I-1 and Comparative Examples I-1 to I-3

Each of the development apparatuses of Example I-1 and Comparative Examples I-1 to I-3 used a developer material comprising a mixture of a binder-type carrier with an average particle size of 35 $\mu$m and a toner with an average particle size of 8 $\mu$m and having a toner concentration of 13 wt %.

The image bearing member 1 was initially charged to a surface potential $V_0$ of −450 V. In the development region wherein the developer carrier members 11*a* and 11*b* each oppose the image bearing member 1, a spacing Ds of 0.35 mm was defined between the respective developer carrier members 11*a* and 11*b* and the image bearing member 1.

The image bearing member 1 was rotated at a system speed of 380 mm/sec whereas the developer carrier members 11*a* and 11*b* were each rotated at a speed 1.6 times the rotational speed of the image bearing member 1. The developer carrier member 11*a* upstream of the movement of the image bearing member 1 was adapted to transport 4.8 mg/cm$^2$ of developer material to the development region.

Then, the developer carrier members 11*a* and 11*b* were applied with the DC voltages from the DC voltage sources 14*a* and 14*b* and the AC voltages from the AC voltage sources 15*a* and 15*b*, respectively, so that the development process was performed by subjecting the respective gaps between the developer carrier member 11*a* and the image bearing member 1 and between the developer carrier member 11*b* and the image bearing member 1 to an electric field established by superimposing the AC electric field on the DC electric field.

In each of the development apparatuses of Example I-1 and Comparative Examples I-1 and I-2, the developer carrier members 11*a* and 11*b* were applied with DC voltages Vda and Vdb of −350 V from the DC voltage sources 14*a* and 14*b*, respectively, so as to subject the respective gaps between the developer carrier members 11*a* and 11*b* and the image bearing member 1 to the electric field established by superimposing the AC electric field on the DC electric field. In the active period of 'Ta' and 'Tb', a single-frequency AC pulse voltage with a peak-to-peak value Vpp of 1.6 kV and a pulse width of 0.16 ms from the respective AD voltage sources 15*a* and 15*b* was applied to the developer carrier members 11*a* and 11*b* in a manner such that the direction of the electric field at the beginning of each active period 'Ta' and 'Tb' was reversed at the end of the period. The active periods 'Ta' and 'Tb' were followed by the inactive periods 'ta' and 'tb' to apply no AC electric field, respectively, the inactive period spanning 0.48 ms which was 1.5 times as long as the duration of the active period 'Ta' and 'Tb'.

The development apparatus of Example I-1 was operated such that the aforesaid AC pulse voltages from the AC voltage sources 15*a* and 15*b* were applied to the developer carrier members 11*a* and 11*b* thereby repeatedly subjecting the developer carrier members 11*a* and 11*b* to the active periods 'Ta' and 'Tb' and the inactive periods 'ta' and 'tb', respectively, in a manner, as shown in FIGS. 5(A) and 5(B), such that when the first developer carrier member 11*a* upstream of the movement of the image bearing member 1 was subject to the active period 'Ta', the second developer carrier member 11*b* on the downstream side was subject to the inactive period 'tb' and conversely when the second developer carrier member 11*b* on the downstream side was subject to the active period 'Tb', the first developer carrier member 11*a* on the upstream side was subject to the inactive period 'ta'.

Figure 6:
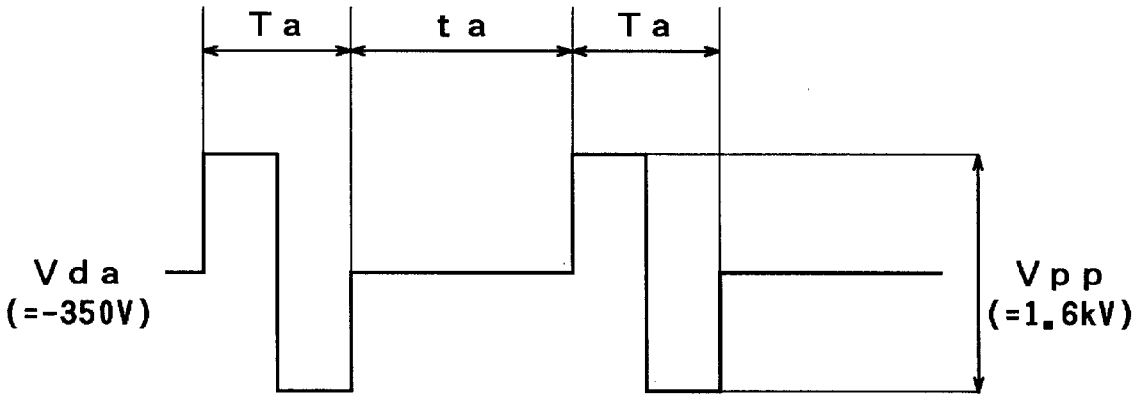
FIG. 6 includes diagrams each showing a state of voltage applied to the two adjacent developer carrier members of a development apparatus according to Comparative Example I-1.
Figure 6:
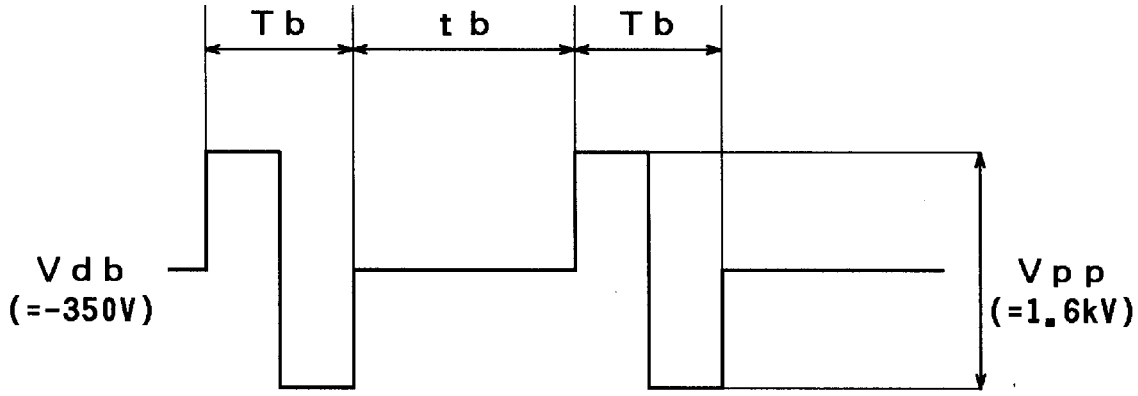

On the other hand, the development apparatus of Comparative Example I-1 was operated such that the developer carrier members 11*a* and 11*b* were repeatedly subject to the active periods 'Ta' and 'Tb' and the inactive periods 'ta' and 'tb', respectively, in a manner such that the developer carrier members 11*a* and 11*b* were simultaneously subject to the active periods 'Ta' and 'Tb' by simultaneously applying thereto AC pulse voltages of the same polarity from the AC voltage sources 15*a* and 15*b* and then subject to the inactive periods 'ta' and 'tb', as shown in FIGS. 6(A) and 6(B).

Figure 7:
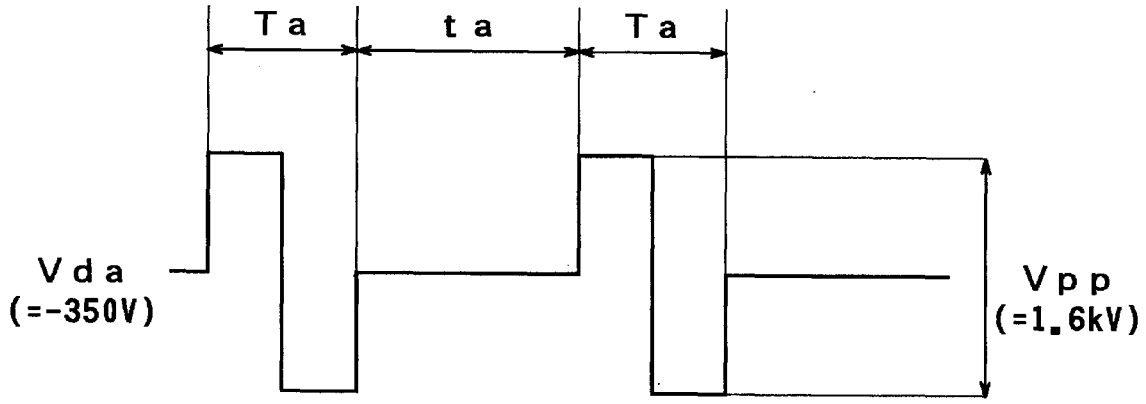
FIG. 7 includes diagrams each showing a state of voltage applied to the two adjacent developer carrier members of a development apparatus according to Comparative Example I-2.
Figure 7:
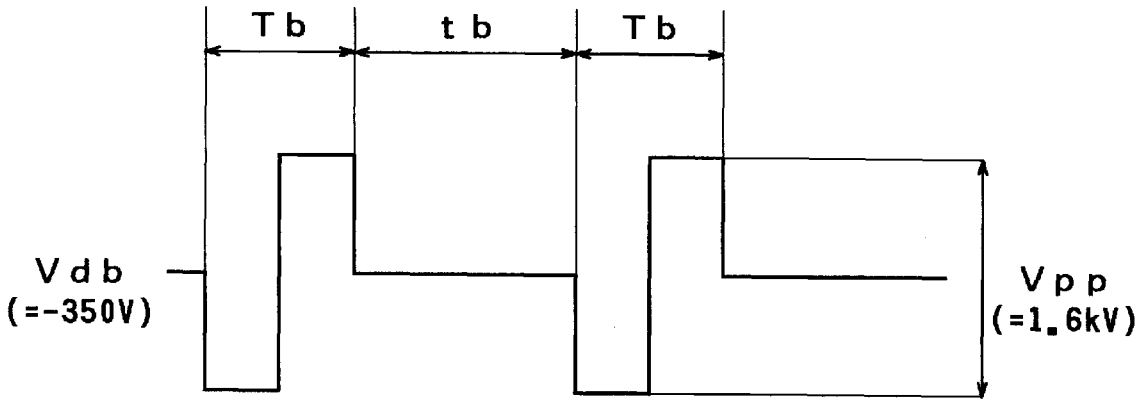

Further, the development apparatus of Comparative Example I-2 was operated such that the developer carrier members 11*a* and 11*b* were repeatedly subject to the active periods 'Ta' and 'Tb' and the inactive periods 'ta' and 'tb', respectively, in a manner such that the developer carrier members 11*a* and 11*b* were simultaneously subject to the active periods 'Ta' and 'Tb' by simultaneously applying thereto AC pulse voltages of opposite polarities from the AC voltage sources 15*a* and 15*b* and then subject to the inactive periods 'ta' and 'tb', as shown in FIGS. 7(A) and 7(B).

Figure 8:
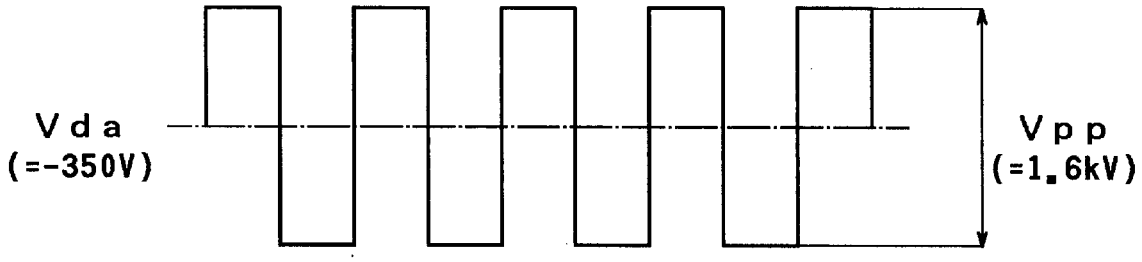
FIG. 8 includes diagrams each showing a state of voltage applied to the two adjacent developer carrier members of a development apparatus according to Comparative Example I-3.
Figure 8:
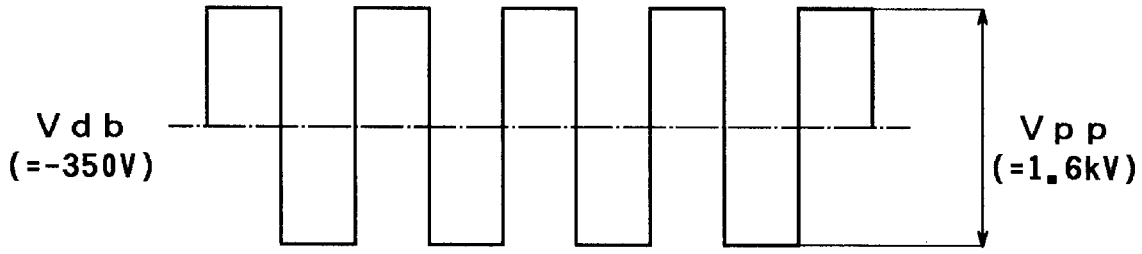

As shown in FIGS. 8(*a*) and 8(B), the development apparatus of Comparative Example I-3 was operated such that the same DC voltages Vda and Vdb of −350 V from the DC voltage sources 14*a* and 14*b* as in Example I-1 and Comparative Examples I-1 and I-2 were applied to the respective developer carrier members 11*a* and 11*b* while the AC pulse voltages with a peak-to-peak value Vpp of 1.6 kV and a pulse width of 0.15 ms from the AC voltage sources 15*a* and 15*b* were continuously applied to the respective developer carrier members 11*a* and 11*b* so as not to subject the developer carrier members 11*a* and 11*b* to the inactive periods.

Figure 9:
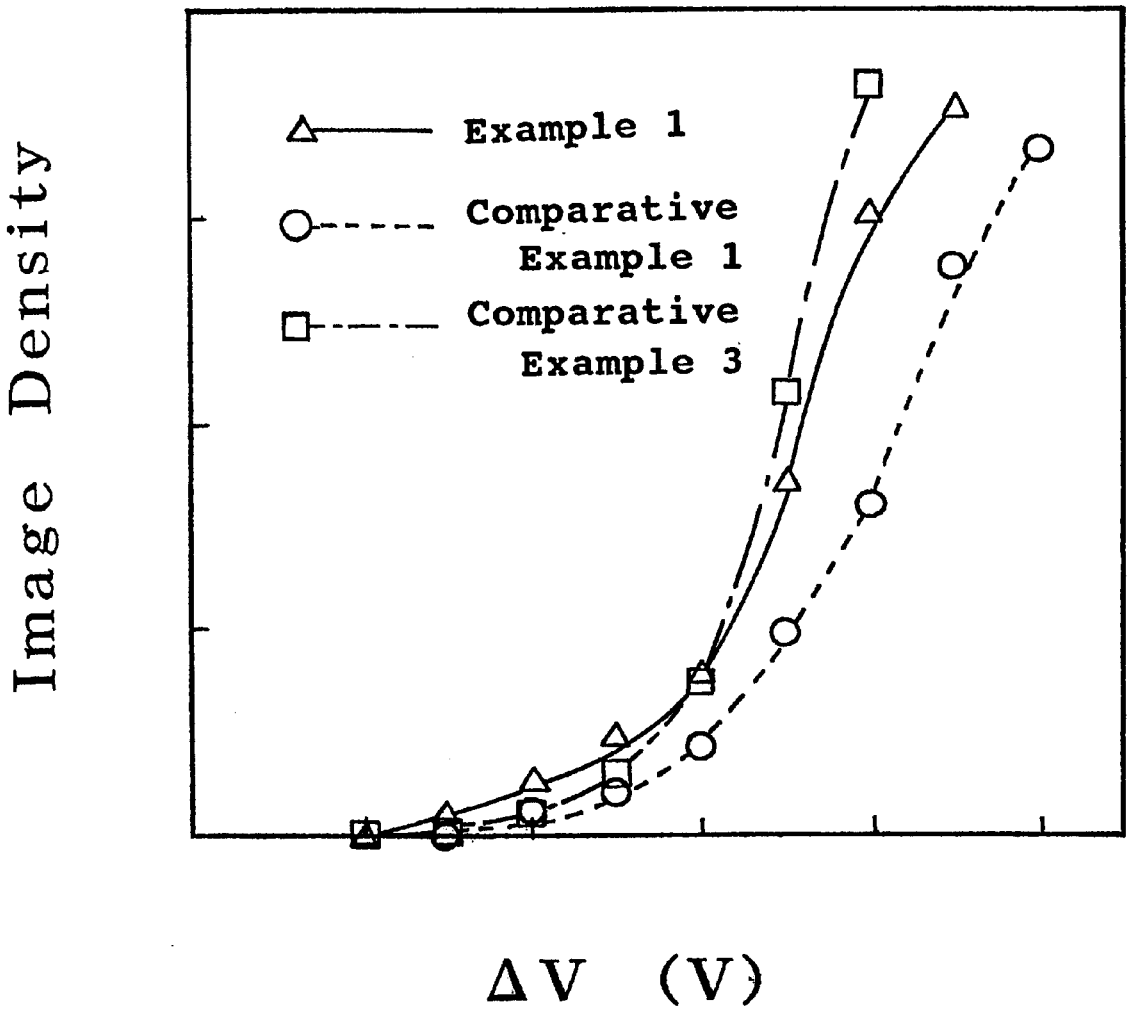
FIG. 9 is a graphical representation showing relationship between image density I.D. and a difference $\Delta V(=Vi-Vb)$ between a surface potential Vi at an image area of the image bearing member exposed to light and a mean value Vb of voltages applied from a DC source and an AC voltage applying device when a reversal development process is performed by each of the development apparatuses according to Example I-1 and Comparative Example I-1 and I-3.

Each of the development apparatuses of Example I-1 and Comparative Examples I-1 to I-3 performed the reversal development process by applying the electric field in the aforementioned manners. Examination was made on the relation between a difference ΔV(=Vi−Vb) between a surface potential Vi at the image area of the image bearing member 1 exposed to light and a mean value Vb of voltages applied from the DC voltage sources 14*a* and 14*b* and from the AC voltage sources 15*a* and 15*b*, and an image density I.D. of resultant images. The results are shown in FIG. 9. Incidentally, the development apparatus of Comparative Example 2 produced no image because of current leakage between the adjacent developer carrier members 11*a* and 11*b*.

As apparent from FIG. 9, the development apparatus of Example I-1 develops images with higher image density than the development apparatus of Comparative Example I-1 because the image bearing member 1 of Example I-1 is supplied with a sufficient amount of developer material. In comparison with the development apparatus of Comparative Example I-3 wherein the AC electric field is continuously applied, the development apparatus of Example I-1 develops images featuring better gradations including halftone by virtue of smaller variations in the image density incident to variations in the potential difference ΔV.

Examples I-2 and I-3

Development apparatuses of Examples I-2 and I-3 were operated the same way as the development apparatus of Example I-1, except for that the developer carrier member 11*b* downstream of the movement of the image bearing member 1 was applied with an AC pulse voltage different from that in Example I-1.

Figure 10:
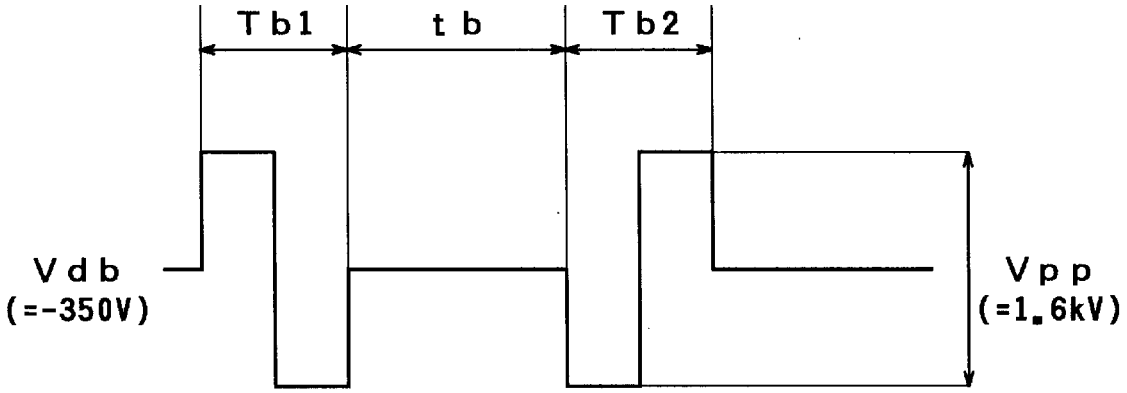
FIG. 10 is a diagram showing a state of voltage applied to a second developer carrier member disposed downstream of a movement of the image bearing member of a development apparatus according to Example I-2 of the invention.

As seen in FIG. 10, the development apparatus of Example I-2 was operated such that a single-frequency AC pulse voltage with a pulse width of 0.16 ms in a first active period 'Tb1' which was followed by an inactive period 'tb' spanning 0.48 ms during which no AC electric field was applied. The inactive period 'tb' was followed by a second active period 'Tb2' during which a single-frequency AC pulse voltage with an opposite polarity to that of the AC pulse voltage in the preceding active period 'Tb1' so that the AC electric field at the beginning of the succeeding active period 'Tb2' may be applied in the same direction with the AC electric field at the end of the preceding active period 'Tb1'.

Figure 11:
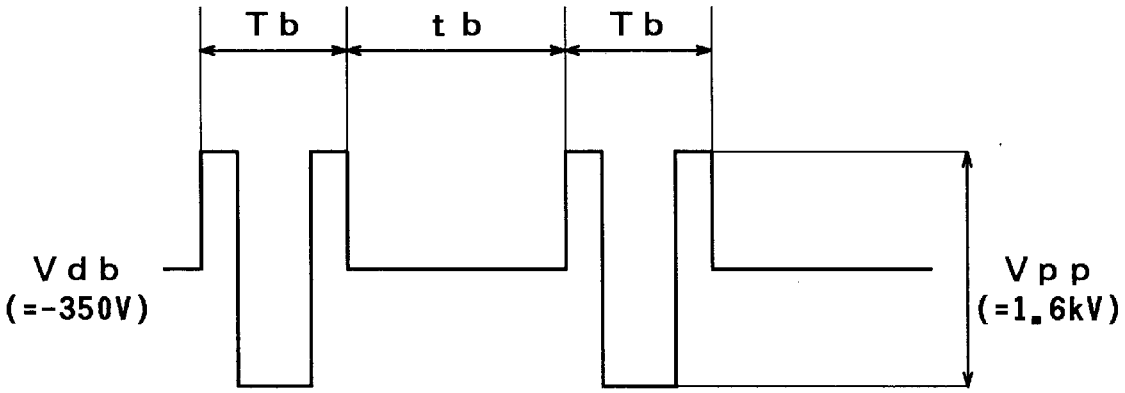
FIG. 11 is a diagram showing a state of voltage applied to the two adjacent developer carrier members of the development apparatus according to Example I-3 of the invention.

As seen in FIG. 11, the development apparatus of Example I-3 was operated such that the AC electric field was applied in such a manner as to apply the electric field in the same direction at the beginning and the end of the active period or in the direction to transport the developer material to the image bearing member 1. More specifically, in the first period 'Tb', there were applied a first and a third, or the last, pulse voltages having a pulse width of 0.08 ms and the same polarity, between which interposed was a second pulse voltage having a pulse width of 0.16 ms and the opposite polarity to the first and last pulse voltages. The active period was followed by the inactive period 'tb' spanning 0.48 ms during which no AC electric field was applied. Thus, the AC electric field was applied in cycles of the active period and the inactive period.

The development apparatuses of Example I-1 and Examples I-2 and I-3 performed the development process to produce halftone images having an average image density I.D. of 0.4. The resultant images were each measured on the image density for a 10 μm×100 μm area at space intervals of 5 μm, so that a standard deviation of image density was determined for each of the halftone images so as to evaluate the variations of the image density (texture) thereof. The results are shown in the following Table 1. Incidentally, Microdensitometer (Model No. 2405 commercially available from Abe Designing Co. Ltd.) was employed for the measurement of the image density.

TABLE 1

| | Example I-1 | Example I-2 | Example I-3 |
|---|---|---|---|
| Texture (Standard Deviation) | 0.0492 | 0.0477 | 0.0461 |

According to the results, the values of standard deviations indicative of the degree of finess of image texture become smaller in the order of Example I-1, Example I-2 and Example I-3, in which order the halftone images have smaller variations of image density. That is, greater improvement in the image texture is accomplished in the order of Example I-1, Example I-2 and Example I-3.

Example I-4

In a development apparatus of Example I-4, the developer carrier members 11*a* and 11*b* were applied with DC voltages from the DC voltage sources 14*a* and 14*b* and AC voltages from the AC voltage sources 15*a* and 15*b*, respectively, thereby subjecting the respective gaps between the developer carrier members 11*a* and 11*b* and the image bearing member 1 to the electric field established by superimposing the AC electric field on the DC electric field, but the first developer carrier member 11*a* upstream of the movement of the image bearing member 1 was applied with a DC voltage Vda of −450 V from the DC voltage source 14*a*, which was of a higher negative value than that applied in the development apparatus of Example I-1. This allowed the first developer carrier member 11*a* to supply an adequate amount of toner to the image bearing member 1.

On the other hand, the second developer carrier member 11*b* downstream of the movement of the image bearing member 1 was applied with the same DC voltage Vdb of −350 V from the DC voltage source 14*b* as in Example I-1.

Further, in the development apparatus of Example I-4, the second developer carrier member 11*b* was applied with the same AC voltage as in Example I-1 whereas the first developer carrier member 11*a* was applied with an AC pulse voltage having a peak-to-peak value Vpp of 0.6 kV which was lower than that of Example I-1. Except for the above, the development apparatus of this example was applied with the AC electric field in the same manner as in Example I-1. That is, the inactive periods 'ta' and 'tb' spanned 0.48 ms which was 1.5 time as long as the duration of the and active periods 'Ta' and 'Tb'. When the first developer carrier member 11*a* upstream of the movement of the image bearing member 1 was subject to the active period 'Ta', the second developer carrier member 11*b* on the downstream side was subject to the inactive period 'tb' and conversely when the second developer carrier member 11*b* on the downstream side was subject to the active period 'Tb', the first developer carrier member 11*a* on the upstream side was subject to the inactive period 'ta'.

According to the development apparatus of Example I-4 wherein the first developer carrier member 11*a* was applied with the AC pulse voltage with the decreased peak-to-peak value from the AC voltage source 15*a*, carrier adhesion was reduced when the first developer carrier member 11*a* supplied the toner contained in the developer material to the image bearing member 1. Particularly, if the first developer carrier member 11*a* upstream of the movement of the image bearing member 1 supplies an adequate amount of toner to the image bearing member 1, an area of the image bearing member 1 thus supplied with the toner is reduced in the strength of the electric field as rotated downstream and thus, the carrier adhesion is further reduced when the AC electric field is applied to the second developer carrier member 11*b* on the downstream side for performing the development process.

The development apparatuses of Example I-1 and I-4 were used to produce a thousand copies of a A-4 size chart with a black-to-white area ratio of 6% (B/W ratio), respectively. Subsequently, a developer material recovered by a cleaning unit (not shown) of each development apparatus was roasted and measurement was taken on the weight of the roasted developer material. Then, a content of carrier in the recovered developer material was found based on preliminarily acquired data on roasted carrier and toner, so that a carrier consumption after production of 1000 copies was calculated.

The results show that the development apparatus of Example I-1 consumes 0.13 g of carrier while the development apparatus of Example I-4 consumes less, or 0.10 g of carrier, to produce 1000 copies.

Example I-5 and I-6

A development apparatus of Example I-5 was operated the same way as in Example I-1 except for that AC pulse voltages different from those in Example I-1 were applied from the AC voltage sources 15*a* and 15*b* to the developer carrier members 11*a* and 11*b*, respectively.

Figure 12:
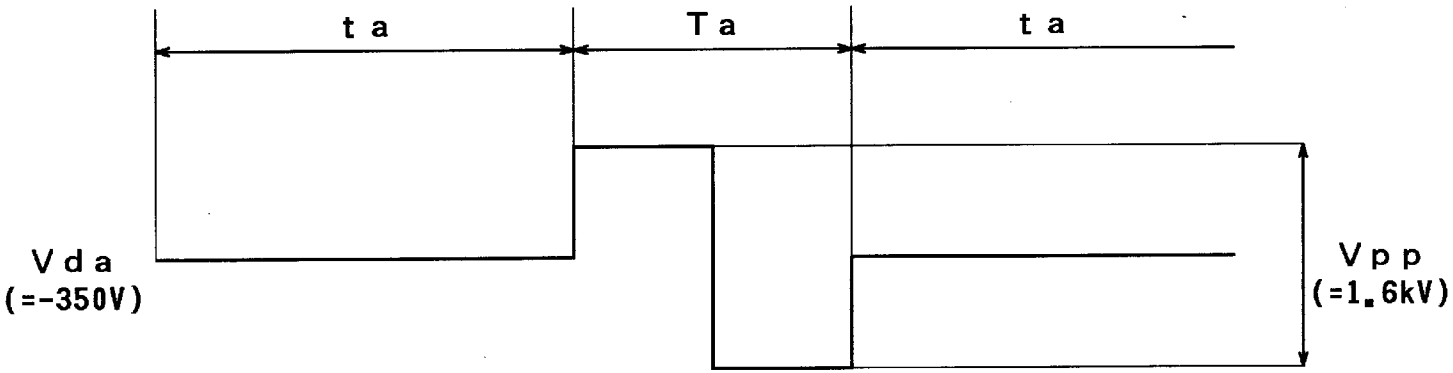
FIG. 12 includes diagrams showing states of voltages applied to the developer carrier members disposed upstream and downstream of a movement of the image bearing member of a development apparatus according to Example I-5 of the invention, respectively.
Figure 12:
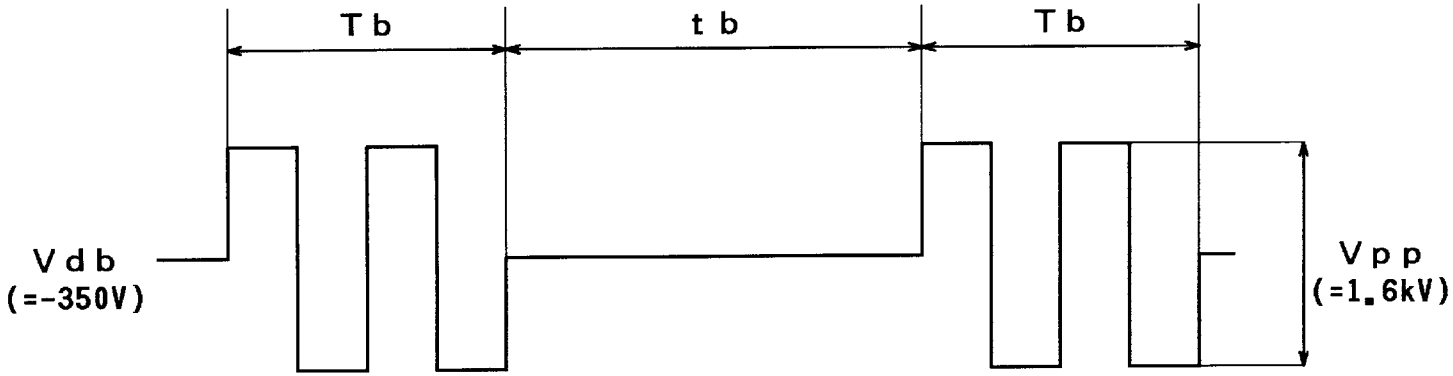

As shown in FIG. 12(A), the development apparatus of Example I-5 was operated in a manner such that the first developer carrier member 11*a* upstream of the movement of the image bearing member 1 was subject to the active period 'Ta' during which a single-frequency AC pulse voltage with a peak-to-peak value Vpp of 1.6 kV and a wider pulse width of 0.32 ms than in Example I-1 was applied from the AC voltage source 15*a*, the active period followed by the inactive period 'ta' spanning 0.96 ms which was 1.5 times as long as the duration of aforesaid active period 'Ta'. The active period and the inactive period were repeated in an alternating sequence.

On the other hand, the second developer carrier member 11*b* on the downstream side was applied with a double-frequency AC pulse voltage with a peak-to-peak value Vpp of 1.6 kV and a pulse width of 0.16 ms from the AC voltage source 15*b* while the developer carrier member 11*a* on the upstream side was in the inactive period 'ta', as seen in FIG. 12(B). This active period 'Tb' was followed by the inactive period 'tb' to apply no AC electric field which spanned 0.96 ms or 1.5 times as long as the duration of the aforesaid active period 'Tb'. The active and inactive periods were repeated in an alternating sequence. More specifically, when the first developer carrier member 11*a* on the upstream side was in the active period 'Ta', the second developer carrier member 11*b* on the downstream side was subject to the inactive period 'tb' and conversely when the second developer carrier member 11*b* on the downstream side was in the active period 'Tb', the first developer carrier member 1*a* on the upstream side was subject to the inactive period 'ta'.

A development apparatus of Example I-6 was operated the same way as in Example I-1 except for that the first developer carrier member 11*a* upstream of the movement of the image bearing member 1 was applied with an AC pulse voltage of a different duty ratio from the AC voltage source 15*a*.

Figure 13:
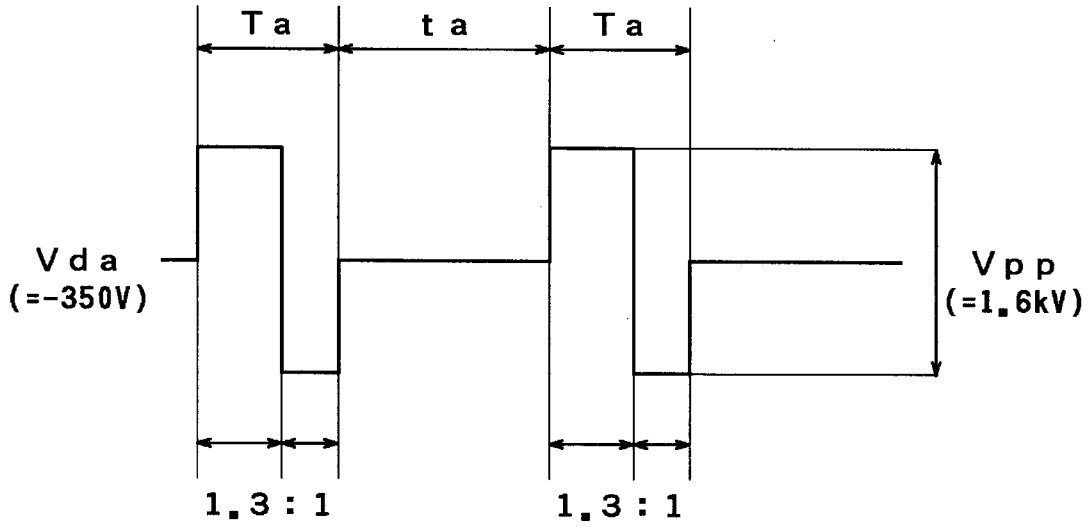
FIG. 13 is a diagram showing a state of voltage applied to the developer carrier member disposed upstream of a movement of the image bearing member of a development apparatus according to Example I-6 of the invention.

In the development apparatus of Example I-6, there was applied a one-frequency AC pulse voltage having a wavelength of 0.32 ms and a duty ratio of 1.3:1 such that a pulse voltage with a greater width may be applied in a direction to supply the toner to the image bearing member 1, as shown in FIG. 13.

The development apparatuses of Examples I-5, I-6 and I-1 were used to perform the development process so that the reproducibility of fine lines was evaluated.

The results show that the development apparatuses of Examples I-5 and I-6 are improved in the reproducibility of fine lines as compared with the development apparatus of Example I-1.

More specifically, the development apparatus of Example I-5 allows the first developer carrier member 11*a* to supply an increased amount of toner to the image bearing member 1 because the first developer carrier member 11*a* upstream of the movement of the image bearing member 1 is applied with the AC pulse voltage having a greater pulse width than that applied in Example I-1. Likewise, the development apparatus of Example I-6 also allows the first developer carrier member 11*a* to supply an increased amount of toner to the image bearing member 1 because the AC pulse voltage applied to the first developer carrier member 11*a* upstream of the movement of the image bearing member 1 is changed in the duty ratio so as to increase the width of the pulse voltage applied in the direction to transport the toner to the image bearing member 1.

Thus, supplying the increased amount of toner from the first developer carrier member 11*a* to the image bearing member 1 assures that fine line areas recorded on the image bearing member 1 are adequately supplied with the toner. On the other hand, the second developer carrier member 11*b* on the downstream side performs a normal development process so as to recover the toner supplied in excess to the image bearing member 1 and thus is assured the production of images free from fogs and featuring good reproducibility of fine lines.

Mode II

Figure 14:
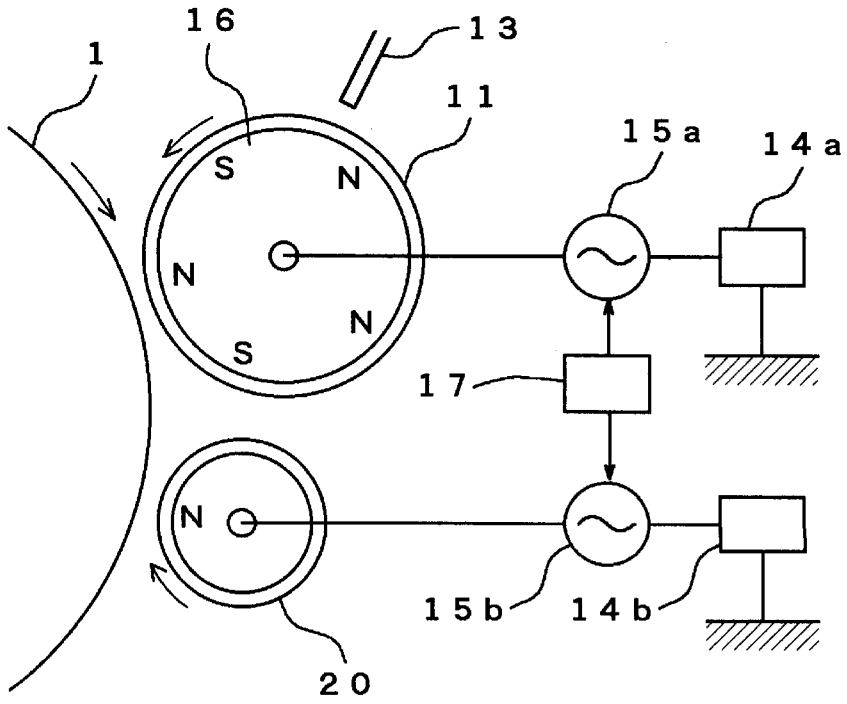
FIG. 14 is a schematic diagram showing a state in which the development process is performed by a development apparatus according to Mode II of the invention.

As shown in FIG. 14, a development apparatus according to Mode II of the invention comprises a cylindrical developer carrier member 11 with a magnet roller 16 mounted to its inner periphery, the developer carrier member opposed by the image bearing member 1 and so rotated as to move in the same direction with the image bearing member 1 in the development region opposed by the image bearing member 1. Supplied with a developer material, the developer carrier member 11 holds the developer material to its surface by way of a magnetic force of the magnet roller 16 and rotates the developer material toward the image bearing member 1. After the regulating member 13 has regulated the amount of developer material to be transported to the development region, the developer material is supplied to the development region for development of the electrostatic latent image recorded on the image bearing member 1.

At place downstream of the developer carrier member 11 in the direction of the movement of the image bearing member 1, disposed is a cylindrical recovery member 20 opposing the image bearing member 1 and having a magnetic N-pole attached to its inner periphery. At a gap between the recovery member 20 and the image bearing member 1 in opposed relation, the rotating recovery member is adapted to move in an opposite direction to the image bearing member 1. The rotation of the recovery member 20 in the opposite direction to the movement of the image bearing member 1 produces an air flow which, in turn, serves to return a toner scattered from the development region between the developer carrier member 11 and the image bearing member 1 in opposed relation.

The developer carrier member 11 and the recovery member 20 are connected with the DC voltage sources 14*a* and 14*b* and the AC voltage sources 15*a* and 15*b* from which DC voltages and AC voltages are applied to the developer carrier member 11 and the recovery member 20, respectively, so that the respective gaps between the developer carrier member 11 and the image bearing member 1 and between the recovery member 20 and the image bearing member 1 may be subject to the electric fields established by superimposing the AC electric field on the DC electric field. On the other hand, the control device 17 serves to control a timing to apply the AC voltages from the AC voltage sources 15*a* and 15*b* to the developer carrier member 11 and the recovery member 20, respectively.

Figure 15:
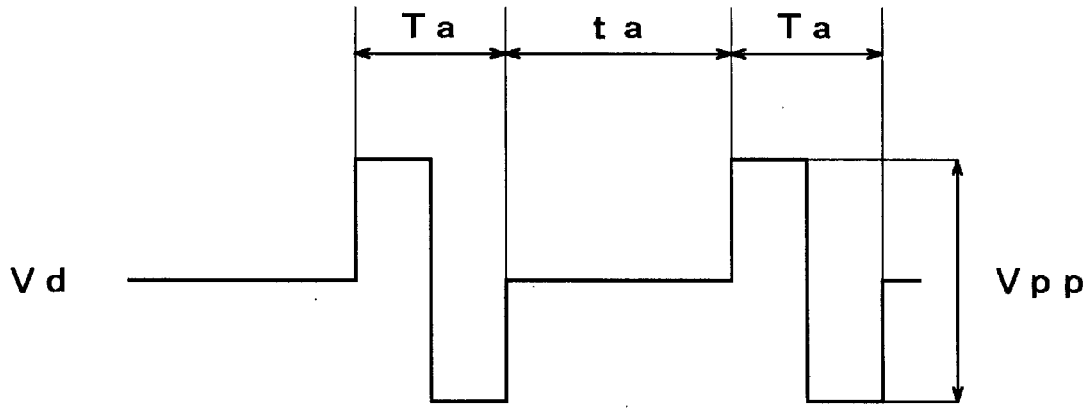
FIG. 15 includes diagrams showing states of voltages applied to the developer carrier member and a recovery member of the development apparatus according to Mode II of the invention, respectively.
Figure 15:
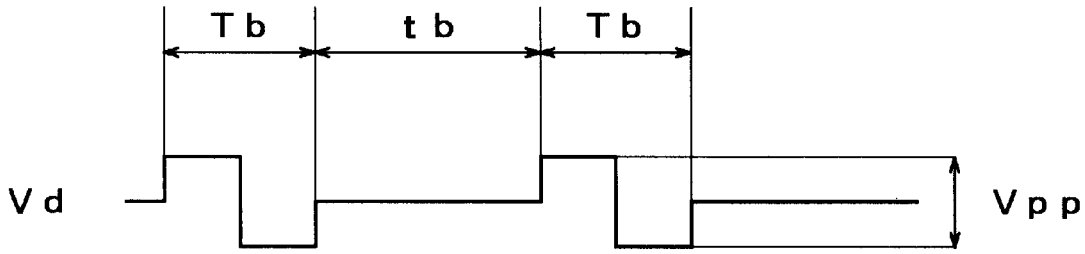

As shown in FIGS. 15(A) and 15(B), the development apparatus according to Mode II of the invention is operated in a manner such that the electric field with the AC electric field superimposed on the DC electric field is applied to the respective gaps between the developer carrier member 11 and the image bearing member 1 and between the recovery member 20 and the image bearing member 1 based on the active periods 'Ta' and 'Tb' to apply the AC electric field and the inactive periods 'ta' and 'tb' to apply no AC electric field, respectively, the active period and the inactive period repeated in an alternating sequence. When the gap between the developer carrier member 11 and the image bearing member 1 is subject to the active period 'Ta' to be applied with the AC electric field, the gap between the recovery member 20 and the image bearing member 1 is subject to the inactive period 'tb' to be applied with no AC electric field. Conversely, when the gap between the recovery member 20 and the image bearing member 1 is subject to the active period 'Tb' to be applied with the AC electric field, the gap between the developer carrier member 11 and the image bearing member 1 is subject to the inactive period 'ta' to be applied with no AC electric field.

As to the development apparatus according to Mode II of the invention, a comparison was made among development apparatuses of Examples II-1 to II-4 and of Comparative Examples II-1 and II-2 which performed the development process under varied operating conditions such as electric fields applied to the gaps between the developer carrier member 11 and the image bearing member 1 and between the recovery member 20 and the image bearing member 1, and the like. The comparison clarifies the development process performed by the development apparatuses of the examples of the invention reduces toner scattering.

Example II-1

The development apparatus of Example II-1 employed a developer material comprising a mixture of a binder type carrier with an average particle size of 35 $\mu$m and a toner with an average particle size of 8 $\mu$m and having a toner concentration of 13 wt %. The image bearing member 1 of the development apparatus was initially charged to a surface potential Vo of −450 V and rotated at a high rotational speed of 380 mm/sec.

On the other hand, the developer carrier member 11 was so disposed as to define a spacing Ds of 0.35 mm from the opposing image bearing member 1 in the development region defined therebetween. The developer carrier member 11 was rotated at a rotational speed 1.8 times that of the image bearing member 1 whereas the regulating member 13 limited to 4.7 mg/cm$^2$ the amount of developer material transported by the developer carrier member 11 to the development region.

Figure 16:
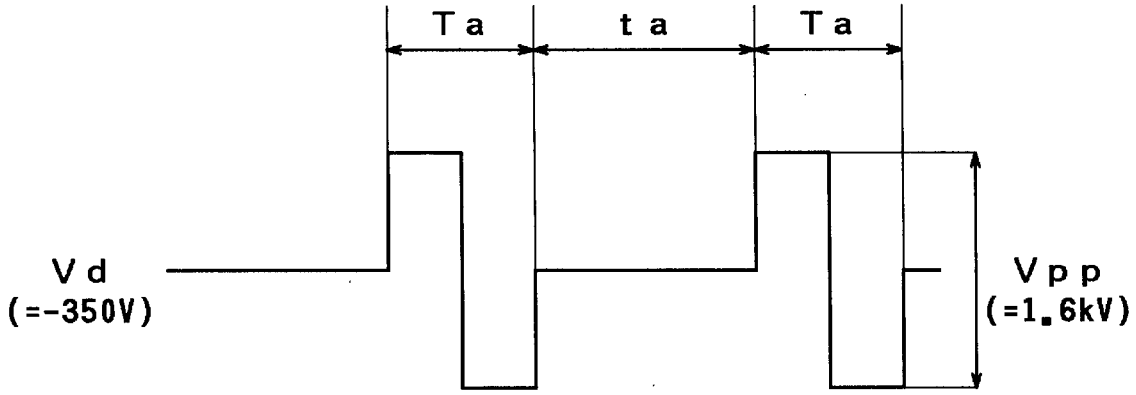
FIG. 16 includes diagrams showing states of voltages applied to the developer carrier member and the recovery member of the development apparatus according to Example II-1 of the invention, respectively.
Figure 16:
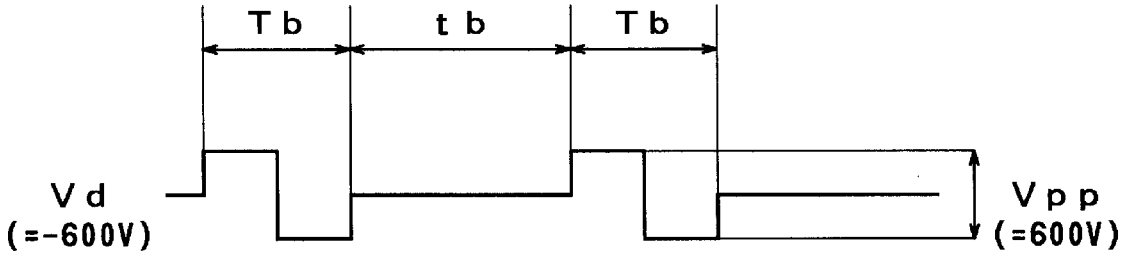
Figure 17:
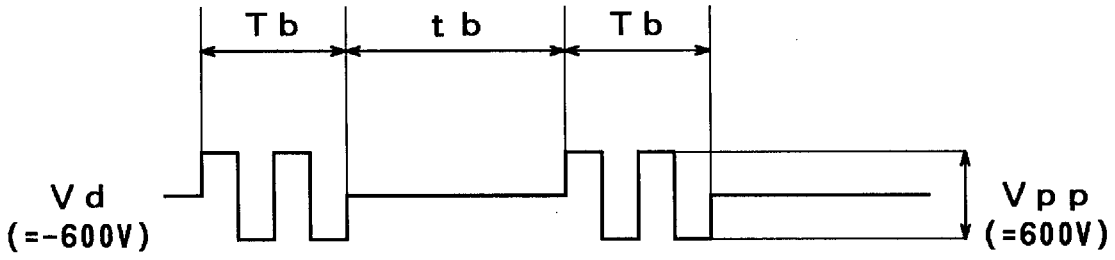
FIG. 17 is a diagram showing a state of voltage applied to the recovery member of a development apparatus according to Example II-2 of the invention.

As seen in FIG. 16(A), the developer carrier member 11 was applied with a DC voltage Vd of −350 V from the DC voltage source 14*a* and with a single-frequency AC pulse voltage having a peak-to-peak value Vpp of 1.6 kV and a pulse width of 0.16 ms in the active period 'Ta', which period was followed by the inactive period 'ta' during which no AC electric field was applied. The inactive period 'ta' spanned 0.48 ms which was 1.5 times as long as the duration of the active period 'Ta'. The active period 'Ta' and the inactive period 'ta' were repeated in an alternating sequence.

On the other hand, the recovery member 20 was rotated at a rotational speed 0.3 times that of the image bearing member 1 so as to return to the developer carrier member 11 the toner scattered from the development region between the developer carrier member 11 and the image bearing member 1 in opposed relation. As seen in FIG. 16(B), the recovery member 20 was applied with a DC voltage Vd of −600 V from the DC voltage source 14*b* and with a single-frequency AC pulse voltage with a peak-to-peak value Vpp of 600 V and a pulse width of 0.16 ms from the AC voltage source 15*b* during the active period 'Tb'. The active period was followed by the inactive period 'tb' spanning 0.48 ms which was 1.5 times as long as the duration of the aforesaid active period 'Tb'. The active period 'Tb' and the inactive period 'tb' were repeated in an alternating sequence.

An arrangement was made such that when the gap between the developer carrier member 11 and the image bearing member 1 was subject to the active period 'Ta' to be applied with the AC electric field, the gap between the recovery member 20 and the image bearing member 1 was subject to the inactive period 'tb' to be applied with no AC electric field. Conversely when the gap between the recovery member 20 and the image bearing member 1 was subject to the active period 'Tb', the gap between the developer carrier member 11 and the image bearing member 1 was subject to the inactive period 'tb' to be applied with no AC electric field.

Example II-2

The development apparatus of Example II-2 was operated the same way as in Example II-1, except for that a different AC voltage from that in Example II-1 was applied to the recovery member 20 from the AC voltage source 15*b*.

In the development apparatus of Example II-2, the recovery member 20 was applied with a double-frequency AC pulse voltage with a pulse width of 0.08 ms in the active period 'Tb'.

Example II-3

The development apparatus of Example II-3 was operated the same way as in Example II-1 except for that the recovery member 20 was rotated at a different rotational speed.

In the development apparatus of Example II-3, the recovery member 20 was rotated at a rotational speed 1.5 times that of the image bearing member 1 or faster than in Example II-1 thereby returning to the developer carrier member 11 the toner scattered from the development region between the developer carrier member 11 and the image bearing member 1 in opposed relation.

Example II-4

Figure 18:
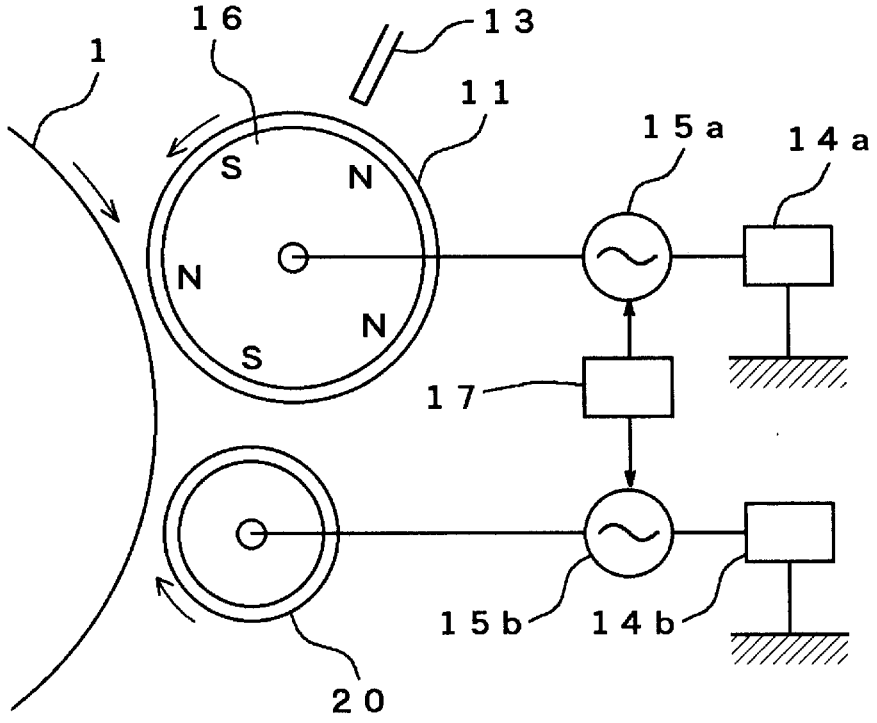
FIG. 18 is a schematic diagram showing a development apparatus according to Example II-4 of the invention.

As seen in FIG. 18, the development apparatus of Example II-4 had an arrangement such that the magnetic N-pole attached to the inner periphery of the recovery member of the development apparatus according to Mode II of the invention was eliminated. Similarly to Example II-3, the recovery member 20 was rotated at a rotational speed 1.5 times that of the image bearing member 1. Furthermore, the recovery member 20 was applied with a DC voltage Vd of −800 V from the DC voltage source 14*b* so as to apply an increased DC electric field to the gap between the recovery member 20 and the developer carrier member 11 in a direction to transport the toner to the developer carrier member 11. Except for the above, the development apparatus of Example II-4 was operated the same way as in Example II-1.

Comparative Example II-1

The development apparatus of Comparative Example II-1 was operated the same way as in Example II-1 except for that AC voltages applied from the AC voltage sources 15*a* and 15*b* to the developer carrier member 11 and the recovery member 20 were varied, respectively.

Figure 19:
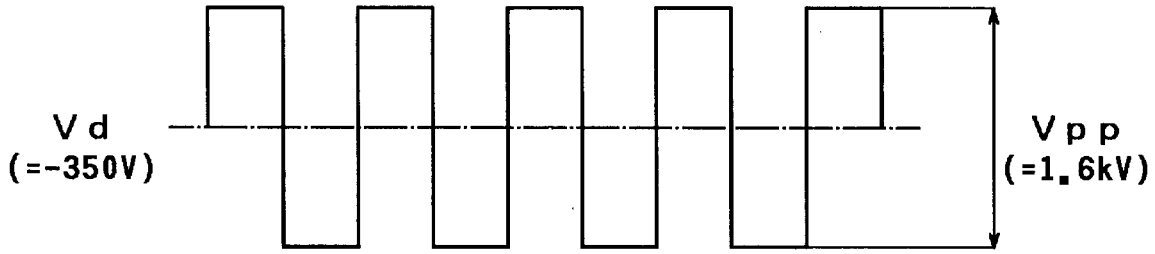
FIG. 19 includes diagrams showing states of voltages applied to the developer carrier member and the recovery member of a development apparatus according to Comparative Example II-1.
Figure 19:
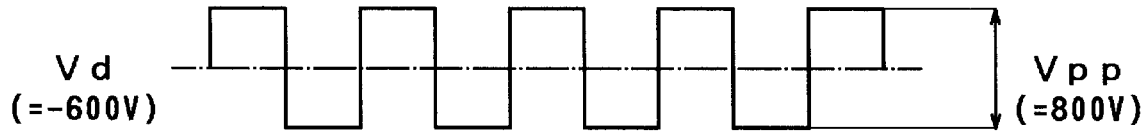

In the development apparatus of Comparative Example II-1, the developer carrier member 11 was continuously applied with an AC pulse voltage with a peak-to-peak value of 1.6 kV and a pulse width of 0.16 ms whereas the recovery member 20 was also continuously applied with an AC pulse voltage with a peak-to-peak value Vpp of 800 V and a pulse width of 0.16 ms in synchronism with the developer carrier member 11, as shown in FIGS. 19(A) and 19(B).

Comparative Example II-2

The development apparatus of Comparative Example II-2 was operated the same way as in Example II-1, except for that the developer carrier member 11 was continuously applied with the AC pulse voltage with a peak-to-peak value Vpp of 1.6 kV and a pulse width of 0.16 ms similarly to Comparative Example II-1 whereas the recovery member 20 was not applied with the AC voltage.

Next, the development apparatuses of Examples II-1 to II-4 and of Comparative Examples II-1 and II-2 were each used to produce 1000 copies of a A4-size chart with a black to white area ratio (B/W ratio) of 6% and an amount of toner scattered out of the development apparatus was obtained. The results are shown in the following Table 2.

After the production of 1000 copies of the A4-size chart by each of the development apparatuses of Examples II-1 to II-4 and of Comparative Examples II-1 and II-2, a developer material recovered by a cleaning unit (not shown) was roasted and a weight thereof was measured. A content of a carrier contained in the recovered developer material was found based on a preliminarily obtained data on roasted toner and carrier so that a consumption of the carrier during the production of 1000 copies was calculated. The results are also shown in the following Table 2.

TABLE 2

| | Example | | | | Comparative Example | |
|---|---|---|---|---|---|---|
| | II-1 | II-2 | II-3 | II-4 | II-1 | II-2 |
| Scattered Toner (mg/1000 copies) | 13 | 9 | 10 | 4 | 35 | 16 |
| Carrier Consumption (mg/1000 copies) | 158 | 164 | 155 | 166 | 162 | 224 |

According to the results, the development apparatuses of Examples II-1 to II-4 accomplish a notable reduction of toner scattering as compared with the development apparatus of Comparative Example II-1, the development apparatuses of the examples of the invention performing the development process by applying the electric field with the AC electric field superimposed on the DC electric field to the respective gaps between the developer carrier member 11 and the image bearing member 1 and between the recovery member 20 and the image bearing member 1 in a manner such that when either of the developer carrier member 11 and the recovery member 20 is subject to the active period, the other is subject to the inactive period, whereas the development apparatus of Comparative Example II-1 performing the development process by continuously applying a similar AC electric field to the respective gaps between the developer carrier member 11 and the image bearing member 1 and between the recovery member 20 and the image bearing member 1. Further, the development apparatuses of the examples of the invention reduce toner scattering and carrier consumption as compared with the development apparatus of Comparative Example II-2 wherein the development process is performed by applying the AC electric field to the gap between the developer carrier member 11 and the image bearing member 1 and no AC electric field to the recovery member 20.

A comparison among the development apparatuses of Examples II-1 to -4 shows that the amount of scattered toner is further reduced in the case of Example II-2 wherein the AC pulse voltage applied to the recovery member 20 has a reduced pulse width so as to increase the frequency thereof, in the cases of Examples II-3 and -4 wherein the recovery member 20 moving in the opposite direction to the image bearing member 1 at the development region between the recovery member 20 and the image bearing member 1 is rotated at an increased rotational speed thereby returning to the developer carrier member 11 the toner scattered from the development region between the developer carrier member 11 and the image bearing member 1 in opposed relation, and in the case of Example II-4 wherein the developer carrier member 11 and the recovery member 20 are each applied with the AC electric field in a manner such that the increased AC electric field is applied in the direction to transport the toner from the recovery member 20 to the developer carrier member 11.

Mode III

Figure 20:
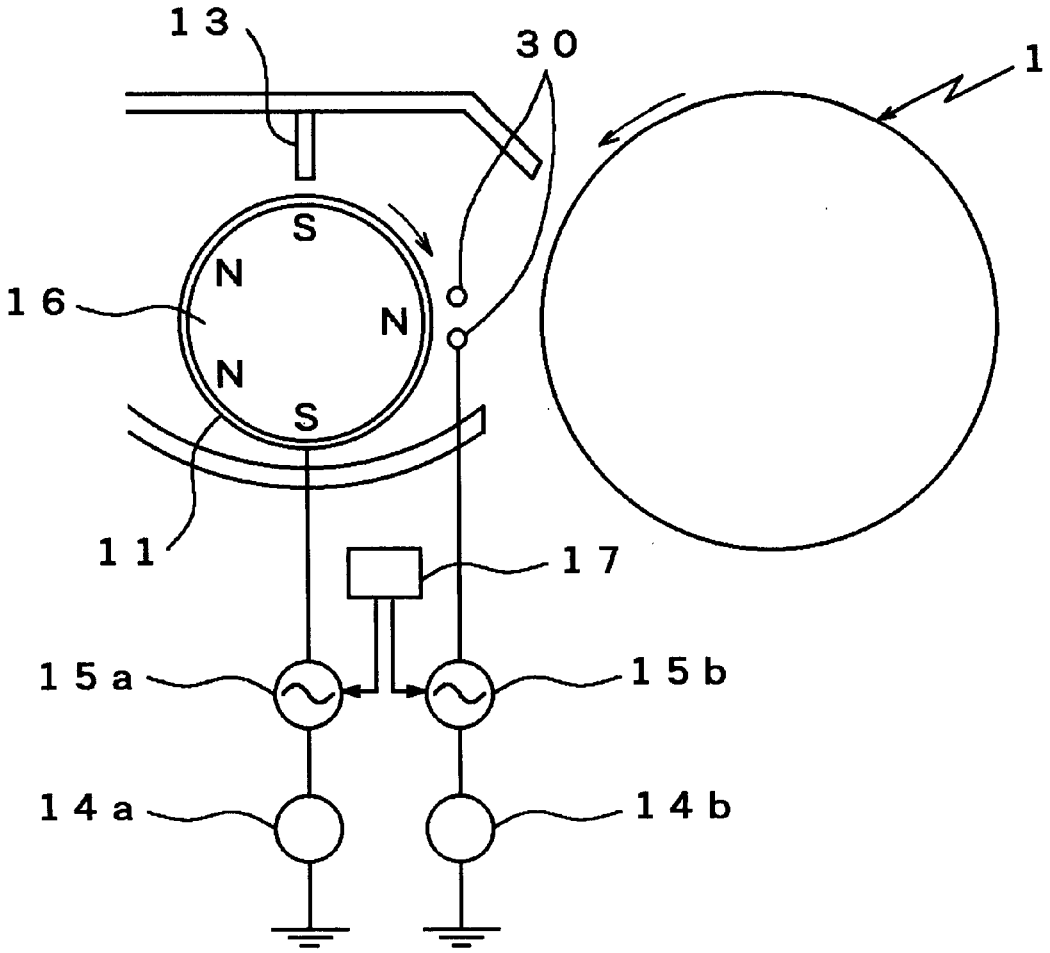
FIG. 20 is a schematic diagram showing a state in which the development process is performed by a development apparatus according to Mode III of the invention.

As shown in FIG. 20, a development apparatus according to Mode III of the invention has an arrangement such that the cylindrical developer carrier member 11 with the magnet roller 16 mounted to its inner periphery is opposed by the image bearing member 1 and rotated in the same direction with the image bearing member 1 in the development region between the image bearing member 1 and the developer carrier member in opposed relation. The developer carrier member 11 holds a supplied developer material to its surface by way of a magnetic force of the magnet roller 16 and rotates to transport the developer material toward the image bearing member 1. After the regulating member 13 has regulated the amount of developer material to be transported to the development region, the developer material is supplied to the development region opposed by the image bearing member 1.

In the development region between the developer carrier member 11 and the image bearing member 1 in opposed relation, two pieces of an electrode member 20 having a diameter of 80 $\mu$m are interposed between the developer carrier member 11 and the image bearing member 1.

The developer carrier member 11 and the electrode member 30 are connected to the DC voltage sources 14*a* and 14*b* and the AC voltage sources 15*a* and 15*b*, respectively. The developer carrier member 11 and the electrode member 30 are applied with DC voltages from the DC voltage sources 14*a* and 14*b* and AC pulse voltages from the AC voltage sources 15*a* and 15*b*, respectively, so that the respective gaps between the developer carrier member 11 and the electrode member 30 and between the electrode member 30 and the image bearing member 1 are subject to an electric field established by superimposing the AC electric field on the DC electric field. On the other hand, the control device 17 serves to control a timing to apply the AC voltages from the AC voltage source 15*a* and 15*b* to the developer carrier member 11 and the electrode member 30, respectively.

Figure 21:
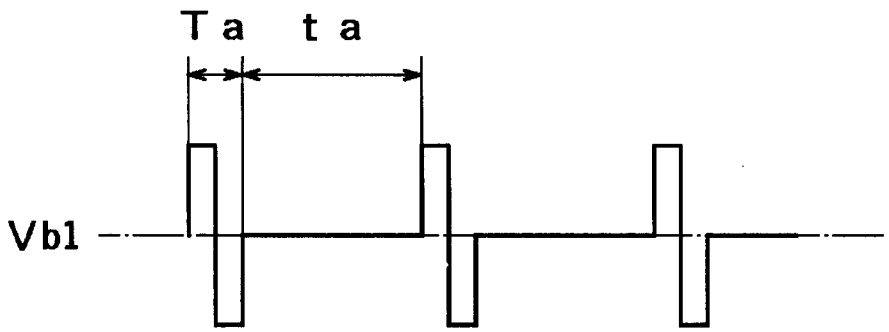
FIG. 21 includes diagrams showing states of voltages applied to the developer carrier member and an electrode member of a development apparatus according to Example III-1 of the invention, respectively.
Figure 21:
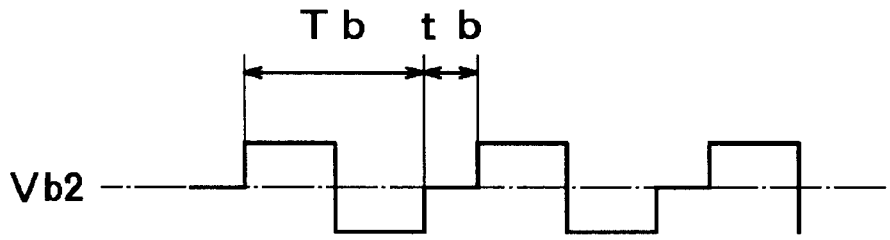

As shown in FIGS. 21(A) and 21(B), the development apparatus according to Mode III of the invention is operated in a manner such that the developer carrier member 11 and the electrode member 30 are applied with the DC voltages from the DC voltage sources 14*a* and 14*b* and the AC pulse voltages from the AC voltage sources 15*a* and 15*b*, respectively, based on the active period 'Ta' and 'Tb' to be applied with the AC pulse voltages and the inactive period 'ta' and 'tb' to be applied with no AC pulse voltages, the active period and the inactive period repeated in an alternating sequence. When the developer carrier member 11 is subject to the active period 'Ta' to be applied with the AC pulse voltage, the electrode member 30 is subject to the inactive period 'tb' to be applied with no AC pulse voltage. Conversely when the electrode member 30 is subject to the active period 'Tb' to be applied with the AC pulse voltage, the developer carrier member 11 is subject to the inactive period 'ta' to be applied with no AC pulse voltage.

As to the development apparatus according to Mode III of the invention, a comparison was made among development apparatuses of Examples III-1 and III-2 and of Comparative Example III-1 wherein the AC pulse voltages applied to the developer carrier member 11 and the electrode member 30 were varied.

Example III-1

The development apparatus of Example III-1 used a developer material comprising a mixture of a binder type carrier with an average particle size of 35 $\mu$m and a toner with an average particle size of 8 $\mu$m and having a toner concentration of 13 wt %. The image bearing member 1 was initially charged to a surface potential of −850 V and then exposed to light so that a light-exposed portion had a potential of −100 V. The image bearing member 1 was rotated at a system speed of 200 mm/sec.

On the other hand, the developer carrier member 11 was disposed to define a spacing DS of 0.70 mm from the image bearing member 1 opposing thereto across the development region and rotated at a peripheral speed 1.8 times that of the image bearing member 1. The regulating member 13 was utilized to limit to 4.5 mg/cm$^2$the amount of developer material transported by the developer carrier member 11 to the development region.

In the development region between the developer carrier member 11 and the image bearing member 1 in opposed relation, the electrode member 30 was interposed between the developer carrier member 11 and the image bearing member 1 so as to define a spacing of 0.3 mm from the developer carrier member 11.

As seen in FIG. 21(A), the developer carrier member 11 was applied with a DC voltage Vb1 of −750 V from the DC voltage source 14*a*. At the same time, the developer carrier member was applied with a single-frequency AC pulse voltage with a peak-to-peak value Vpp of 1.5 kV and a pulse width of 0.24 ms from the AC voltage source 15*a* during the active period 'Ta', which period was followed by the inactive period 'ta' spanning 1.6 ms. The active period 'Ta' and the inactive period 'ta' were repeated in an alternating sequence.

As seen in FIG. 21(B), the electrode member 30 was applied with a DC voltage Vb2 of −750 V from the DC voltage source 14*b*. At the same time, the electrode member was applied with a single-frequency AC pulse voltage with a peak-to-peak value Vpp of 700 V and a pulse width of 0.80 ms from the AC voltage source 15*b* during the active period 'Tb', which period was followed by the inactive period 'tb' spanning 0.80 ms. The active period 'Tb' and the inactive period 'tb' were repeated in an alternating sequence.

As seen in FIGS. 21(A) and 21(B), the development process was performed by applying the AC electric fields to the respective gaps between the developer carrier member 11 and the electrode member 30 and between the electrode member 30 and the image bearing member 1 in a manner such that when the developer carrier member 11 was subject to the active period 'Ta' to be applied with the AC pulse voltage, the electrode member 30 was subject to the inactive period 'tb' to be applied with no AC pulse voltage and when the electrode member 30 was subject to the active period 'Tb' to be applied with the AC pulse voltage, the developer carrier member 11 was subject to the inactive period 'ta' to be applied with no AC pulse voltage.

The development process performed in this manner does not suffer the occurrence of current leakage between the electrode member 30 and the developer carrier member 11. This allows for an efficient separation of a toner from the developer material transported by the developer carrier member 11 to the development region while the toner thus separated is efficiently supplied to the image bearing member 1. As a consequence, this development apparatus offers high-quality images without suffering carrier adhesion or toner scattering.

Example III-2

The development apparatus of Example III-2 had an arrangement wherein the electrode member 30 was disposed in the development region between the developer carrier member 11 and the image bearing member 1 in opposed relation in a manner such that a spacing Ds of 1.0 mm was defined between the developer carrier member 11 and the image bearing member 1 whereas a spacing of 0.4 mm was defined between the electrode member 30 and the developer carrier member 11.

The development apparatus of Example III-2 was operated in a manner such that the developer carrier member 11 and the electrode member 30 were applied with AC pulse voltages different from those of Example III-1 based on active periods 'Ta' and 'Tb' and inactive periods 'ta' and 'tb' which were varied from those of Example III-1.

Figure 22:
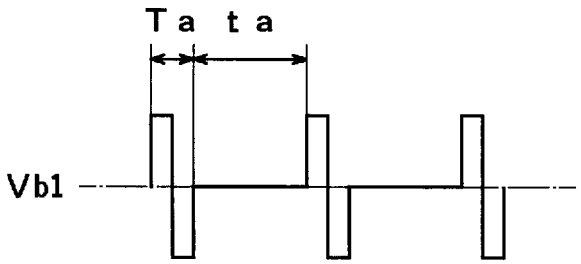
FIG. 22 includes diagrams showing states of voltages applied the developer carrier member and the electrode member of a development apparatus according to Example III-2 of the invention, respectively.
Figure 22:
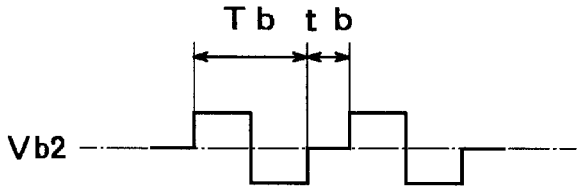

In the development apparatus of Example III-2, as shown in FIG. 22(A), the developer carrier member 11 was applied with a single-frequency AC pulse voltage with a peak-to-peak value Vpp of 2 kV and a pulse width of 0.12 ms from the AC voltage source 15*a* during the active period 'Ta', which period was followed by the inactive period 'ta' spanning 0.64 ms during which no AC pulse voltage was applied. The active period 'Ta' and the inactive period 'ta' were repeated in an alternating sequence. On the other hand, as shown in FIG. 22(B), the electrode member 30 was applied with a single-frequency AC pulse voltage with a peak-to-peak value Vpp of 1 kV and a pulse width of 0.32 ms from the AC voltage source 15*b* during the active period 'Tb', which period was followed by the inactive period 'tb' spanning 0.32 ms during which no AC pulse voltage was applied. The active period 'Tb' and the inactive period 'tb' were repeated in an alternating sequence.

As seen in FIGS. 22(A) and 22(B), the development process was performed by applying the AC electric fields to the respective gaps between the developer carrier member 11 and the electrode member 30 and between the electrode member 30 and the image bearing member 1 in a manner such that when the developer carrier member 11 was subject to the active period 'Ta' to be applied with the AC pulse voltage, the electrode member 30 was subject to the inactive period 'tb' to be applied with no AC pulse voltage and when the electrode member 30 was subject to the active period 'Tb' to be applied with the AC pulse voltage, the developer carrier member 11 was subject to the inactive period 'ta' to be applied with no AC pulse voltage.

Similarly to Example III-1, the development process performed by this development apparatus does not suffer the occurrence of current leakage between the electrode member 30 and the developer carrier member 11. This allows for an efficient separation of a toner from the developer material transported by the developer carrier member 11 to the development region while the toner thus separated is efficiently supplied to the image bearing member 1. As a consequence, the development apparatus offers high-quality images without suffering carrier adhesion and toner scattering.

Comparative Example III-1

The development apparatus of Comparative Example III-1 was operated the same way as in Example III-1 except for that AC pulse voltages varied from those of Example III-1 were applied to the developer carrier member 11 and the electrode member 30 from the AC voltage sources 15*a* and 15*b*, respectively.

Figure 23:
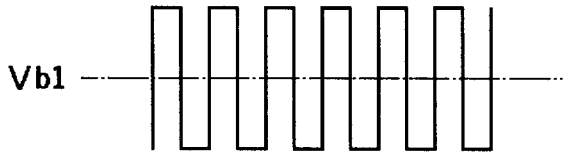
FIG. 23 includes diagrams showing states of voltages applied to the developer carrier member and the electrode member of a development apparatus according to Comparative Example III-1, respectively.
Figure 23:
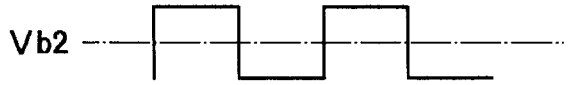

The development apparatus of Comparative Example III-1 performed the development process by continuously applying an AC pulse voltage with a peak-to-peak value Vpp of 1.5 kV and a pulse width of 0.24 ms to the developer carrier member 11, as shown in FIG. 23(A), while continuously applying an AC pulse voltage with a peak-to-peak value Vpp of 700 V and a pulse width of 80 ms to the electrode member 30, as shown in FIG. 23(B).

In this development process, there occurred a temporary increase in the potential difference between the developer carrier member 11 and the electrode member 30, thus causing current leakage therebetween which disabled the execution of a proper development process.

Example III-3

Figure 24:
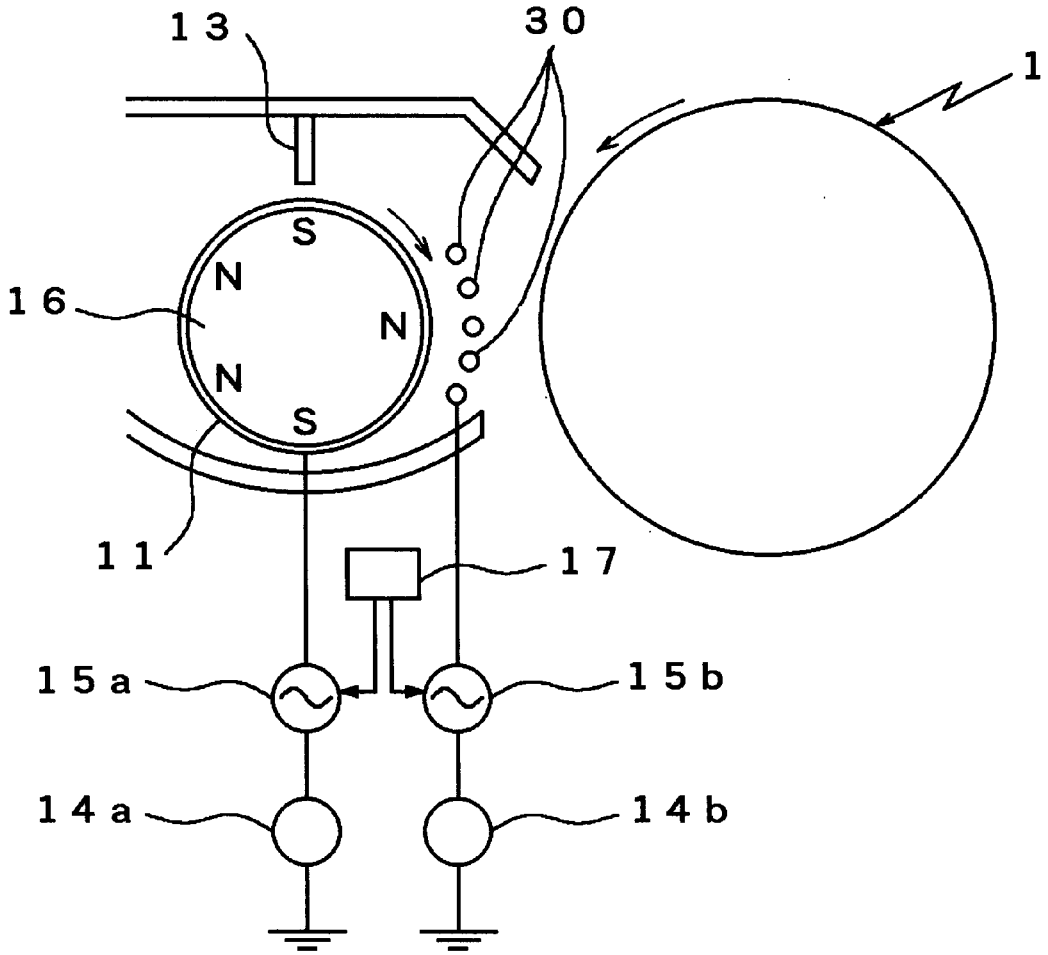
FIG. 24 is a schematic diagram showing a state in which the development process is performed by a development apparatus according to Example III-3 of the invention.

As seen in FIG. 24, the development apparatus of Example III-3 had an arrangement such that in the development region between the developer carrier member 11 and the image bearing member 1 in opposed relation, five pieces of electrode member 30 were interposed between the developer carrier member 11 and the image bearing member 1. Except for the above, the development apparatus of this example performed the development process under the same conditions as in Example III-1.

Similarly to the case of Example III-1, the development apparatus of Example III-3 does not suffer the occurrence of current leakage between the electrode member 30 and the developer carrier member 11. This allows for an efficient separation of a toner from the developer material transported by the developer carrier member 11 to the development region while the toner thus separated is efficiently supplied to the image bearing member 1. As a consequence, the development apparatus of this example offers high-quality images without suffering carrier adhesion or toner scattering.

Example III-4

Figure 25:
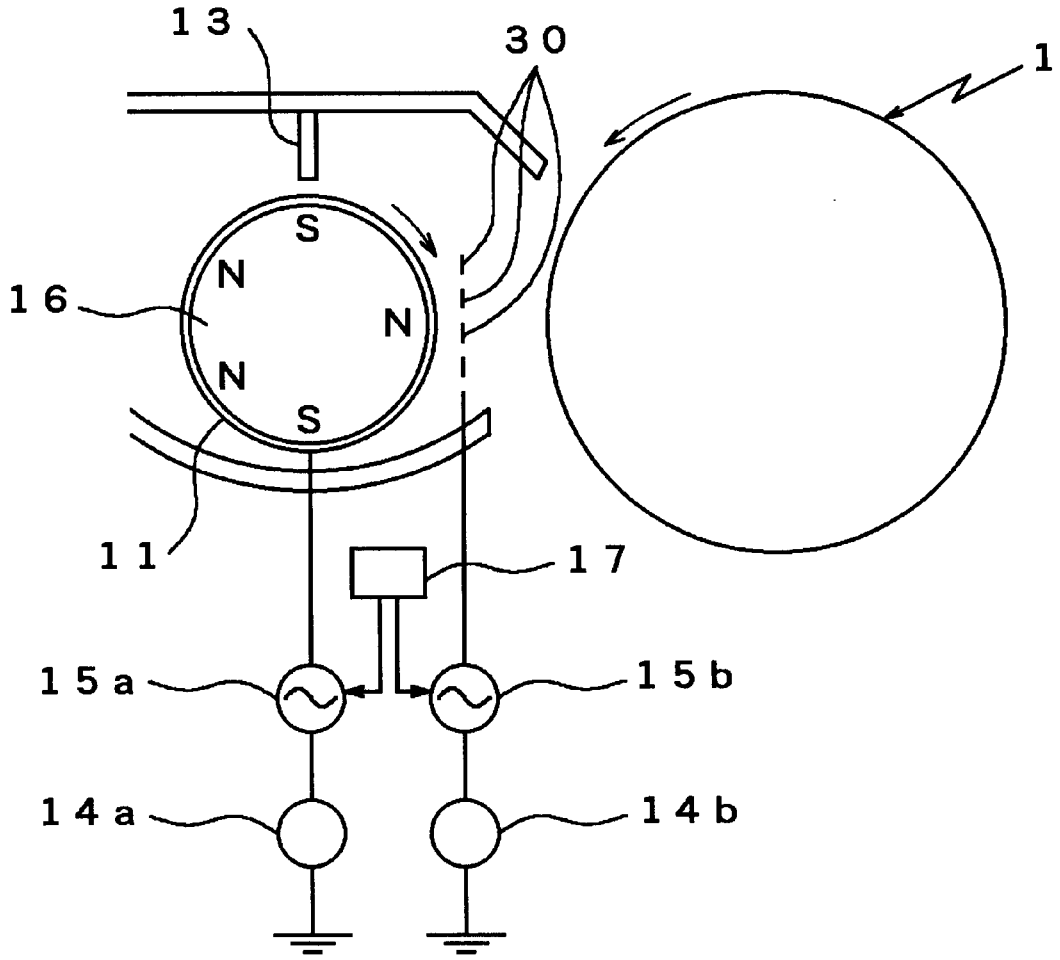
FIG. 25 is a schematic diagram showing a state in which the development process is performed by a development apparatus according to Example III-4 of the invention.

As seen in FIG. 25, the development apparatus of Example III-4 had an arrangement such that in the development region between the developer carrier member 11 and the image bearing member in opposed relation, an electrode member 30 shaped like a grid of a 50 $\mu$m-thick wire was interposed between the developer carrier member 11 and the image bearing member 1. Except for the above, the development apparatus of this example performed the development process under the same conditions as in Example III-1.

Similarly to Example III-1, the development apparatus of Example III-4 does not suffer the occurrence of current leakage between the electrode member 30 and the developer carrier member 11. This allows for an efficient separation of a toner from the developer material transported by the developer carrier member 11 to the development region while the toner thus separated is efficiently supplied to the image bearing member 1. As a consequence, this development apparatus offers high-quality images without suffering carrier adhesion or toner scattering.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

What is claimed is:

1. A development apparatus comprising:

a first developer carrier member opposing an image bearing member across a development region;

a second developer carrier member adjoining the first developer carrier member and opposing the image bearing member across the development region, wherein a common developer is supplied to the image bearing member by both the first and second developer carrier members; and an AC voltage applying device for selectively applying AC voltages to the first developer carrier member and the second developer carrier member, the AC voltage applying device controlled so as not to apply the AC voltage to the second developer carrier member when applying the AC voltage to the first developer carrier member.

2. A development apparatus as set forth in claim 1, wherein at least one of the AC voltages applied by said AC voltage applying device to the first and second developer carrier members has a pulse wave form.

3. A development apparatus as set forth in claim 1, wherein the AC voltages applied by said AC voltage applying device to the first and second developer carrier members have wave forms different from each other.

4. A development apparatus as set forth in claim 1, wherein the AC voltage applying device applies to the first developer carrier member the AC voltage having a different duty ratio from that of the AC voltage applied to the second developer carrier member.

5. A development apparatus comprising:

a developer carrier member opposing an image bearing member across a development region;

a recovery member adjoining said developer carrier member and opposing the image bearing member; and an AC voltage applying device for selectively applying AC voltages to said developer carrier member and said recovery member, the AC voltage applying device controlled so as not apply the AC voltage to the recovery member when applying the AC voltage to the developer carrier member.

6. A development apparatus as set forth in claim 5, wherein at least one of the AC voltages applied by said AC voltage applying device to the developer carrier member and the recovery member has a pulse wave form.

7. A development apparatus as set forth in claim 5, wherein said AC voltage applying device applies to the developer carrier member the AC voltage having a different wave form from that of the AC voltage applied to the recovery member.

8. A development apparatus as set forth in claim 5, wherein said AC voltage applying device applies to the developer carrier member the AC voltage having a different frequency from that of the AC voltage applied to the recovery member.

9. A development apparatus as set forth in claim 5, wherein the developer carrier member opposes the rotated image bearing member across the development region and said recovery member is disposed downstream of the developer carrier member in a direction of the rotation of the image bearing member.

10. A development apparatus comprising:

a developer carrier member opposing an image bearing member across a development region;

an electrode member disposed in said development region as interposed between the image bearing member and the developer carrier member; and an AC voltage applying device for selectively applying AC voltages to said developer carrier member and said recovery member, the AC voltage applying device controlled so as not to apply the AC voltage to the recovery member when applying the AC voltage to the developer carrier member.

11. A development apparatus as set forth in claim 10, wherein at least one of the AC voltages applied by said AC voltage applying device to the developer carrier member and the recovery member has a pulse wave form.

12. A development apparatus as set forth in claim 10, wherein said AC voltage applying device applies to the developer carrier member the AC voltage having a different wave form from that of the AC voltage applied to the recovery member.

13. A development apparatus as set forth in claim 10, wherein said electrode member is shaped like a grid.

14. A development method comprising the steps of:

applying an AC voltage to a first developer carrier member opposing an image bearing member across a development region;

applying an AC voltage to a second developer carrier member adjoining the first developer carrier member and opposing the image bearing member, wherein a common developer is supplied to the image bearing member by both the first and second developer carrier members;

controlling the application of the AC voltages in a manner than when the AC voltage is applied to the first developer carrier member, no AC voltage is applied to the second developer carrier member.

15. A development method comprising the steps of:

applying an AC voltage to a developer carrier member opposing an image bearing member across a development region;

applying an AC voltage to a recovery member adjoining the developer carrier member and opposing the image bearing member; and controlling the application of the AC voltages in a manner that when the AC voltage is applied to the developer carrier member, no AC voltage is applied to the recovery member.

16. A development method comprising the steps of:

applying an AC voltage to a developer carrier member opposing an image bearing member across a development region;

applying an AC voltage to an electrode member disposed in the development region as interposed between the image bearing member and the developer carrier member; and controlling the application of the AC voltages in a manner that when the AC voltage is applied to the developer carrier member, no AC voltage is applied to the electrode member.

* * * * *